US007882710B2

(12) United States Patent
Koenig

(10) Patent No.: US 7,882,710 B2
(45) Date of Patent: Feb. 8, 2011

(54) CIRCULAR KNITTING MACHINE FOR THE PRODUCTION OF KNITTED FABRICS BY AT LEAST PARTIALLY USING FIBRE MATERIALS

(76) Inventor: Reinhard Koenig, Albstrasse 2, 76275 Ettlingen (DE)

( * ) Notice: Subject to any disclaimer, the term of this patent is extended or adjusted under 35 U.S.C. 154(b) by 0 days.

(21) Appl. No.: 12/664,107

(22) PCT Filed: Jun. 4, 2008

(86) PCT No.: PCT/DE2008/000945

§ 371 (c)(1),
(2), (4) Date: Dec. 11, 2009

(87) PCT Pub. No.: WO2008/151608

PCT Pub. Date: Dec. 18, 2008

(65) Prior Publication Data

US 2010/0175429 A1 Jul. 15, 2010

(30) Foreign Application Priority Data

Jun. 14, 2007 (DE) ..... 10 2007 027 467

(51) Int. Cl.
*D04B 9/14* (2006.01)

(52) U.S. Cl. ..... 66/9 B; 66/8

(58) Field of Classification Search ..... 66/9 R, 66/9 B, 8, 168, 190, 191, 194
See application file for complete search history.

(56) References Cited

U.S. PATENT DOCUMENTS

| | | | | |
|---|---|---|---|---|
| 3,226,952 | A * | 1/1966 | Cassady | 66/9 B |
| 3,299,672 | A * | 1/1967 | Schmidt | 66/9 R |
| 3,732,135 | A * | 5/1973 | Ernst et al. | 66/9 B |
| 4,006,609 | A * | 2/1977 | Abler | 66/9 B |
| 4,245,487 | A * | 1/1981 | Schaab et al. | 66/9 B |
| 4,563,884 | A * | 1/1986 | Kunde et al. | 66/9 B |
| 5,134,863 | A * | 8/1992 | Hanna | 66/9 B |
| 5,431,029 | A * | 7/1995 | Kuhrau et al. | 66/9 B |
| 5,809,804 | A * | 9/1998 | Kuhrau et al. | 66/9 B |
| 6,151,920 | A * | 11/2000 | Schindler et al. | 66/9 R |
| 6,247,335 | B1 * | 6/2001 | Schaeberle et al. | 66/9 B |

FOREIGN PATENT DOCUMENTS

| | | |
|---|---|---|
| EP | 1 683 898 | 7/2006 |
| WO | 2004/079068 | 9/2004 |
| WO | 2007/093164 | 8/2007 |
| WO | 2007/093165 | 8/2007 |
| WO | 2007/093166 | 8/2007 |

* cited by examiner

*Primary Examiner*—Danny Worrell
(74) *Attorney, Agent, or Firm*—Michael J. Striker

(57) ABSTRACT

A circular knitting machine for the production of knitted goods by at least partially using fiber materials is described. The circular knitting machine includes drafting devices (8*b*) associated with the individual knitting systems (6) to feed and attenuate slivers (10), flyer frame slivers or the like, and also drive units (28) operatively connected to the drafting devices (8). According to the invention, the drafting devices (8) are arranged below and the drive units (28) are arranged above a partition and mounting wall (26) separating them in a fiber-tight arrangement, wherein the drive units (28) are coupled to drafting rollers (35, 36) of the drafting devices (8*b*) through the partition and mounting wall (26) (FIG. 3).

17 Claims, 33 Drawing Sheets

CIRCULAR KNITTING MACHINE FOR THE PRODUCTION OF KNITTED FABRICS BY AT LEAST PARTIALLY USING FIBRE MATERIALS

The invention relates to a circular knitting machine of the type specified in the preamble of claim 1.

Known circular knitting machines of this type (e.g. PCT WO 2004/079068) are distinguished by the predominant or exclusive use of threads consisting of stretched fibre materials for stitch formation instead of classic yarns. These fibre materials are stretched directly before stitch formation by means of drafting devices associated with the knitting systems, to which flyer frame slivers, drafter slivers or the like are fed as starting materials. If required, these fibre materials can be converted between the drafting devices and the knitting systems by means of spinning devices into temporary yarns with genuine twists, which also allow transport of the sensitive fibre materials over large distances and disappear again before stitch formation as a result of the false twist effect. Thus, the stitch formation is not achieved by means of usual yarns, but with threads without or with only slight twists.

A problem with circular knitting machines of this type is that as a result of processing flyer frame slivers, drafter slivers or the like a significant amount of fluff is formed in the region of the knitting systems, and this is associated with flying fibres, dirt particles or the like. This applies irrespective of whether the fibre material is made of pure cotton or any expedient fibre mixture. As a result, because they are substantially exposed, the drive units used for driving the drafting devices, above all, tend to become quickly fouled so that frequent cleaning operations must be conducted, and this disturbs the knitting process. Or comparatively complicated designs must be provided, which make the necessary operating and maintenance work more difficult.

Working from this, the technical problem forming the basis of the invention is to configure the circular knitting machine of the aforementioned type so that a substantially disturbance-free operation of the drive units and also of the circular knitting machine can be assured with comparatively simple means. Moreover, an inexpensive drive system is to be proposed for the drafting devices.

This object is achieved on the basis of the characterising features of claim 1.

The invention provides the advantage that the partition wall allows a fibre-tight separation of the drafting rollers located at the bottom and responsible for the undesirable generation of fibre fluff from the drive units arranged above the partition wall, which are thus optimally protected from flying fibres or the like. Moreover, the partition wall simultaneously provides a mounting plane, on which all important structural parts for the fibre feed, in particular the drafting devices and their drive units, can be mounted. It is particularly advantageous if the partition wall is arranged at such a height above the usual work area, in particular above the knitting systems of the circular knitting machine, that the drafting devices do not represent a substantial hindrance for the operator working on the circular knitting machine, while still lying within his/her reach.

Further advantageous features of the invention are evident from the sub-claims.

The invention is explained in more detail below by way of exemplary embodiments in association with the attached drawings.

Figure 3:
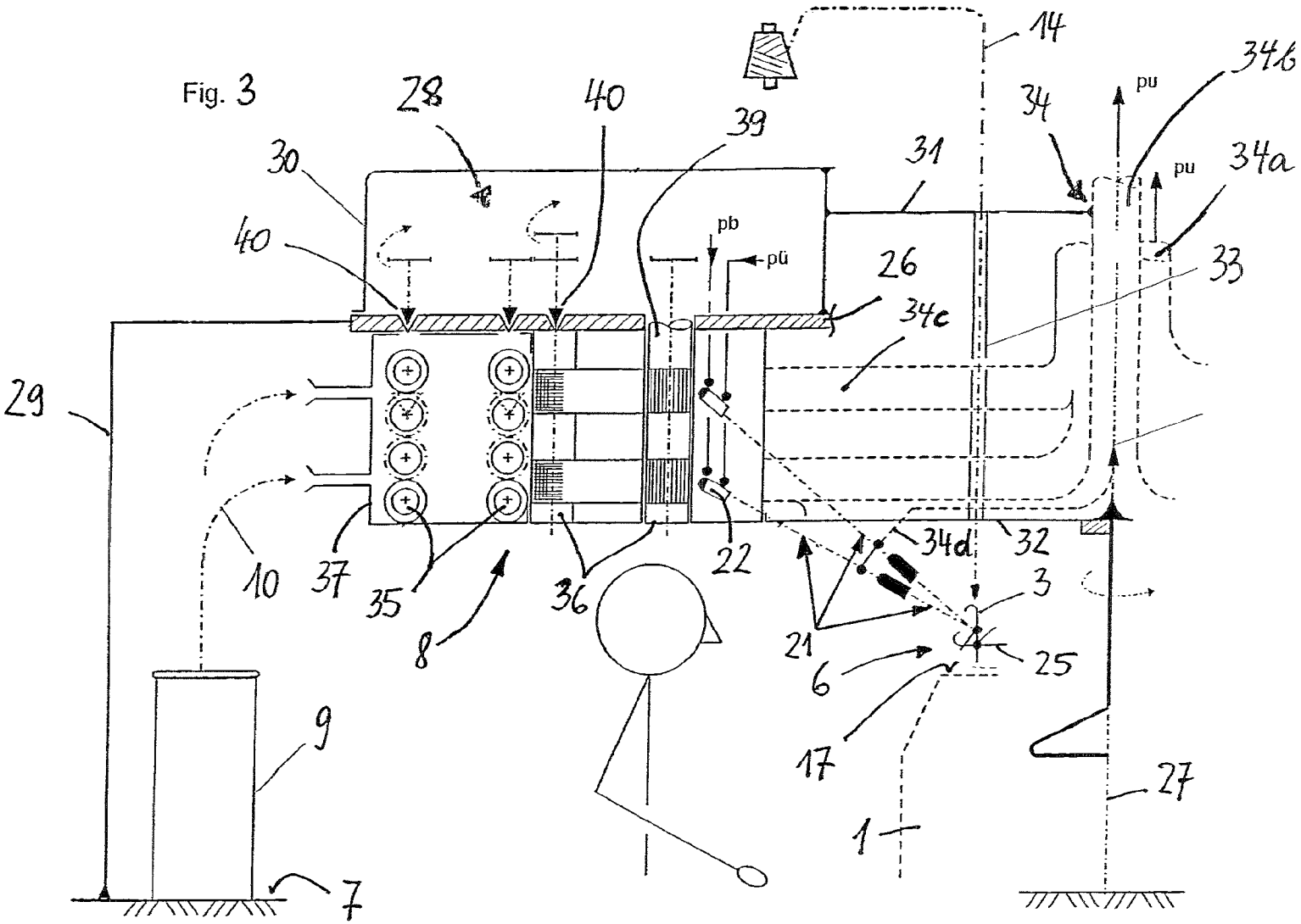
FIG. 3 shows a schematic vertical section through a circular knitting machine with a partition wall according to the invention.
Figure 7A:
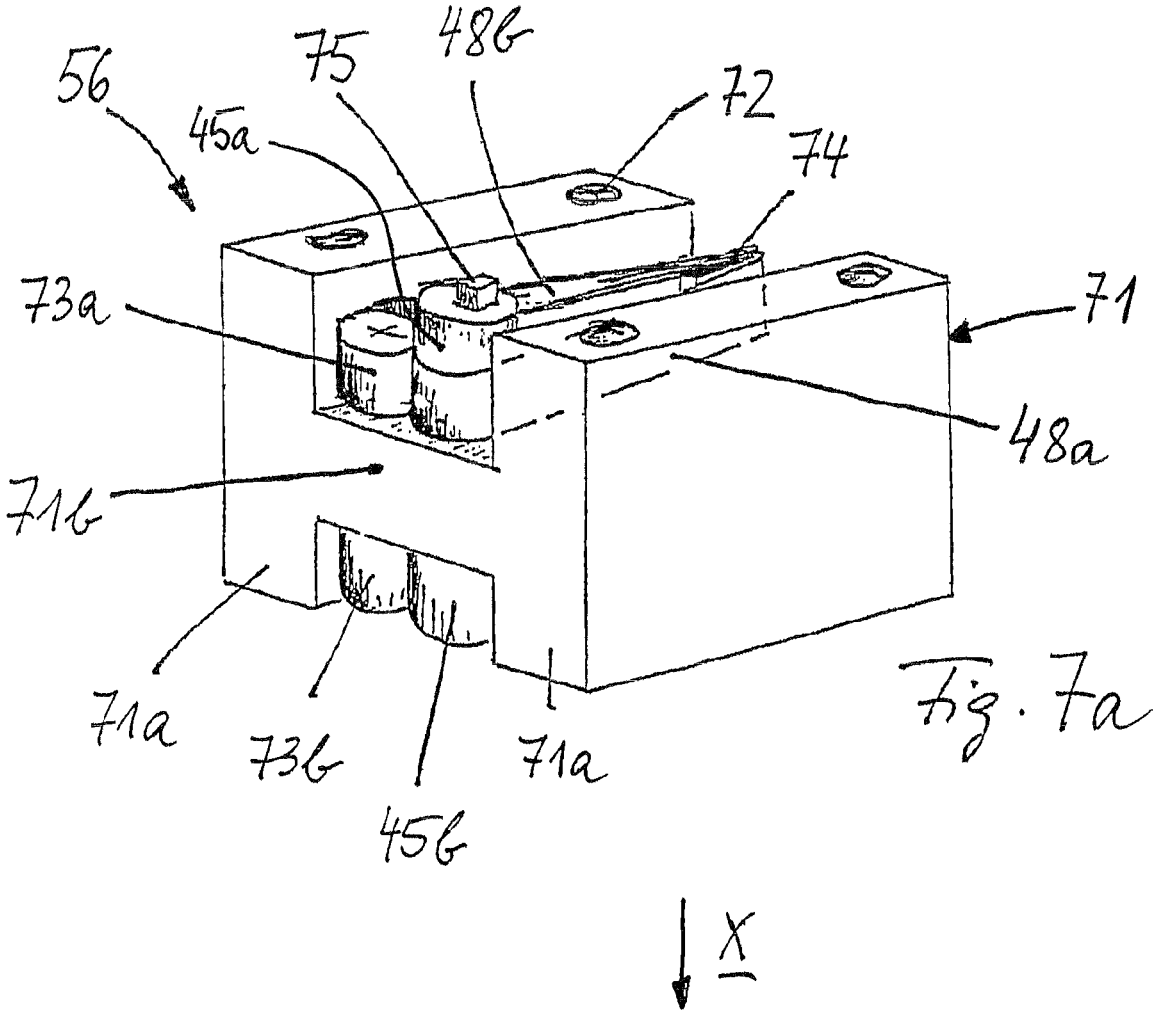
Figure 7B:
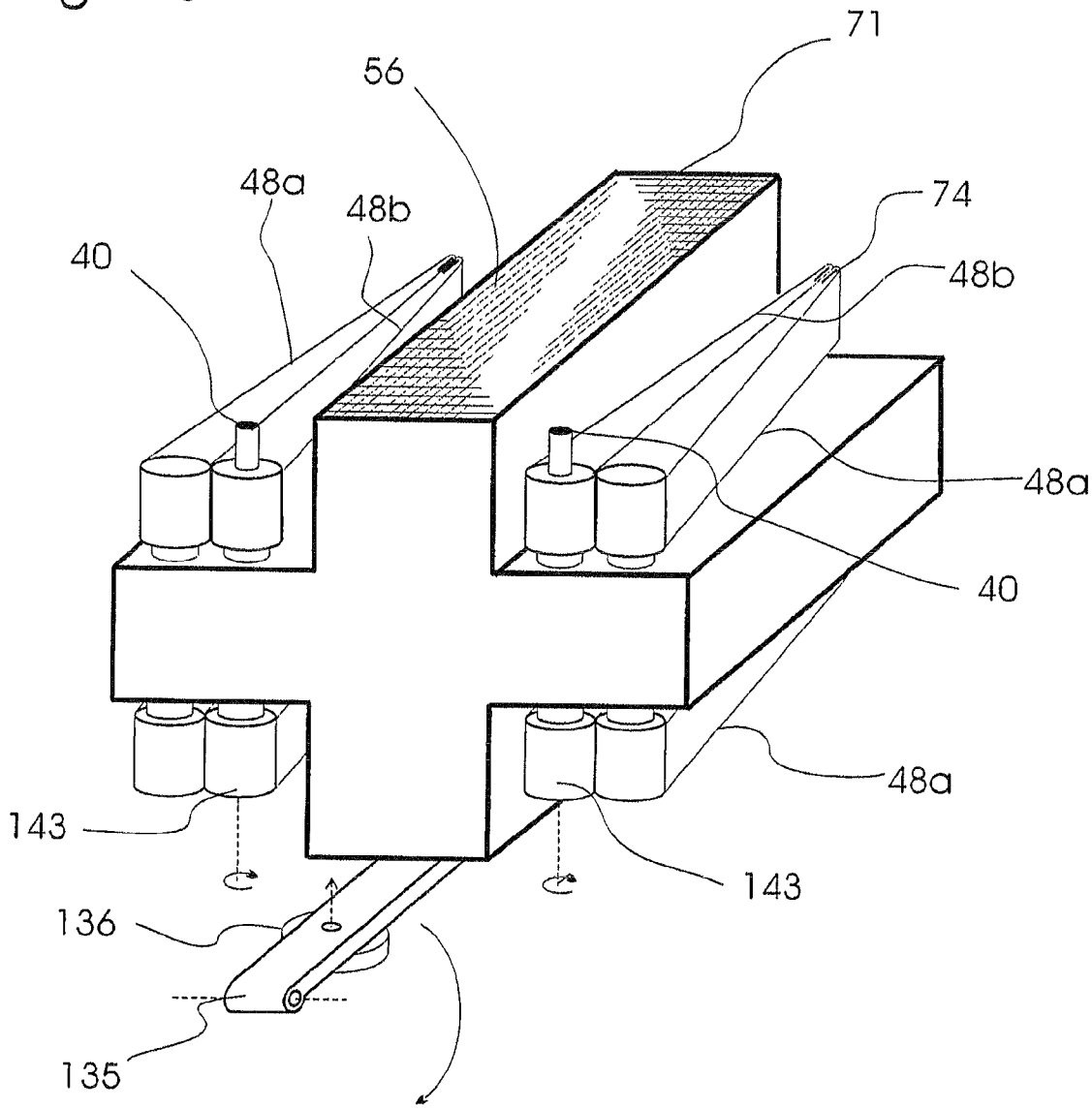
Figure 7C:
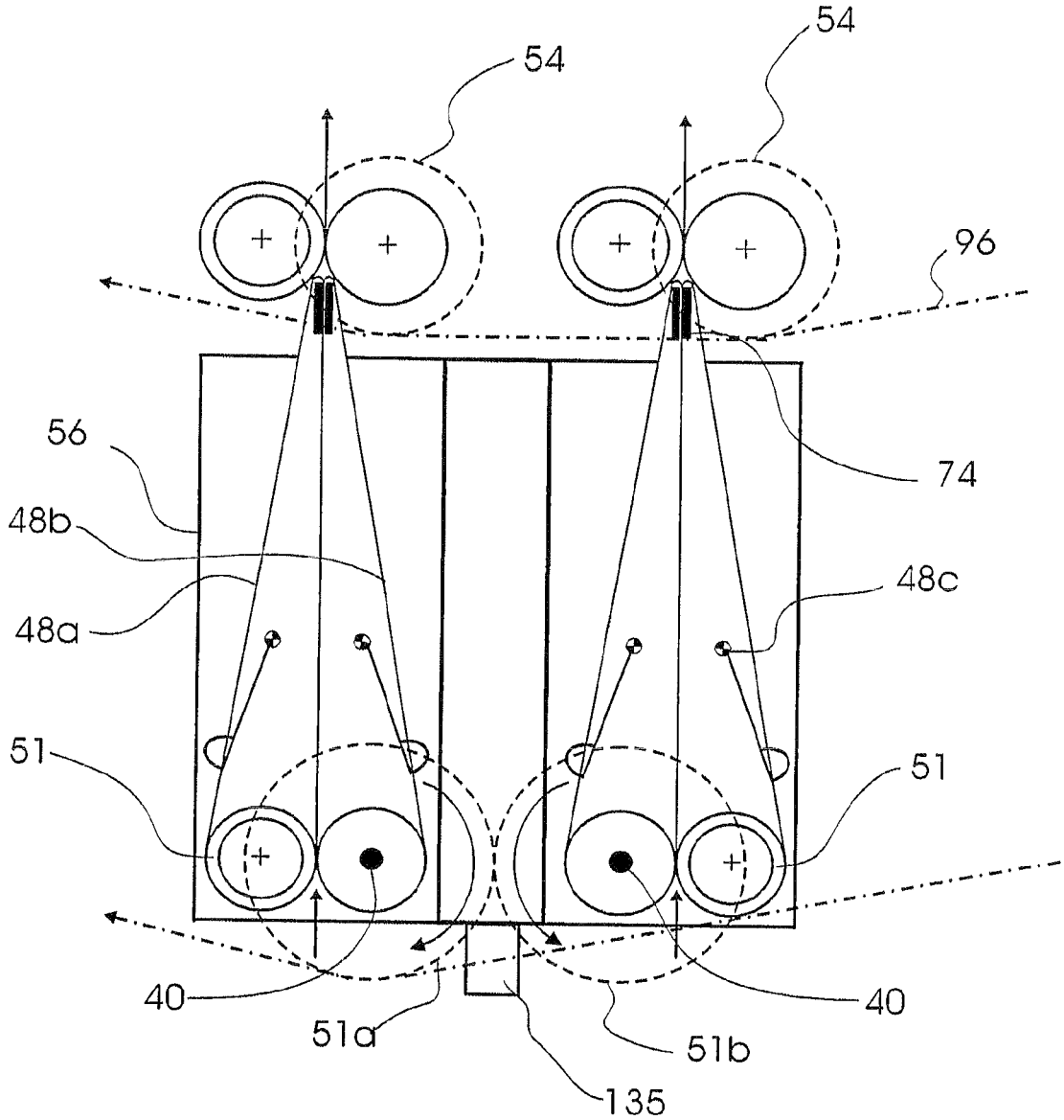
Figure 8:
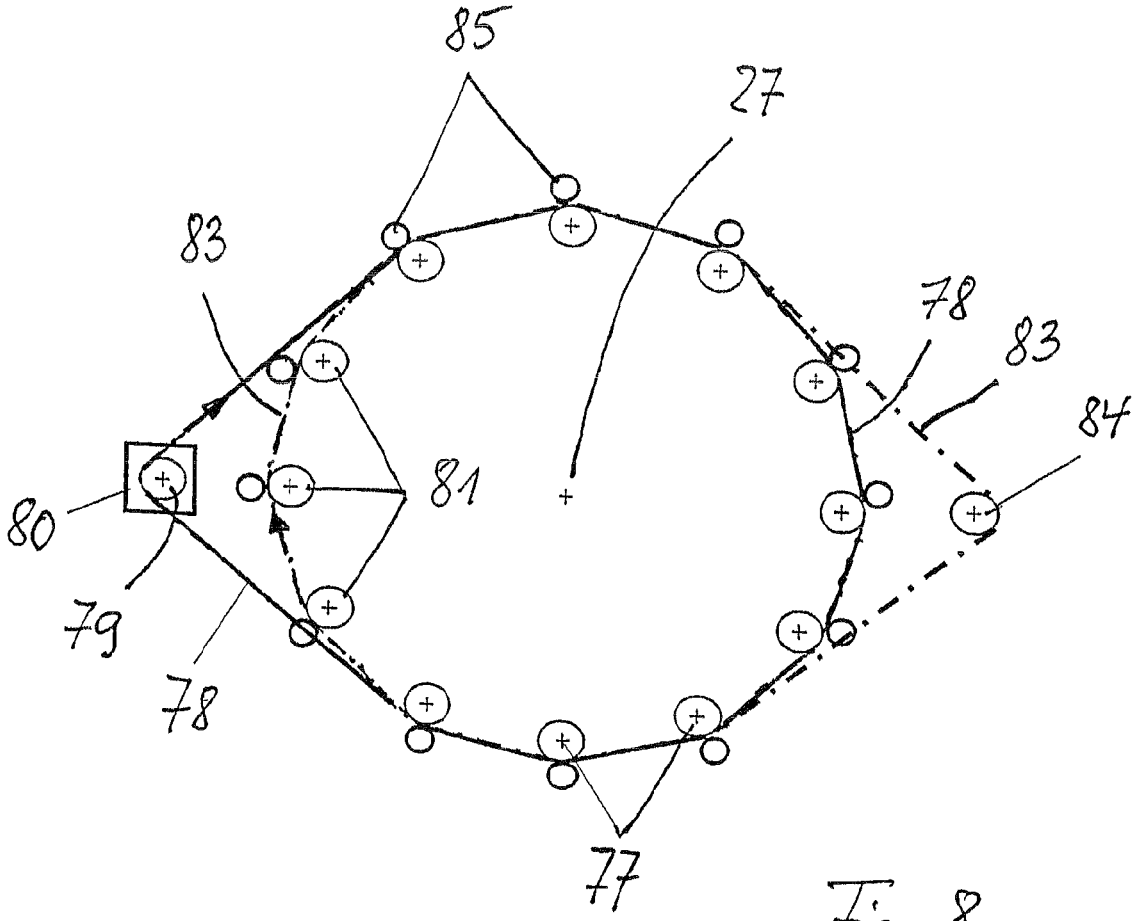
Figure 9:
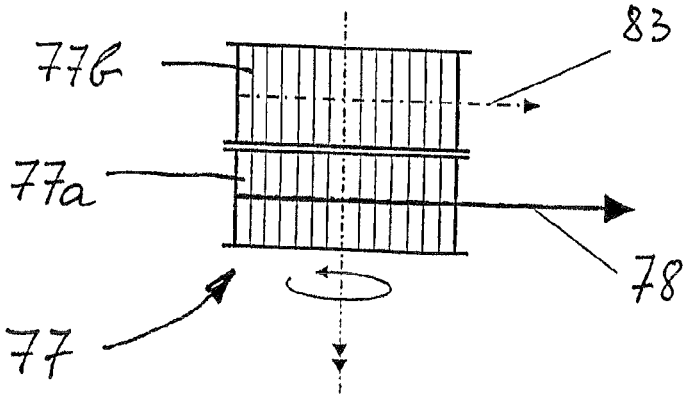
Figure 9A:
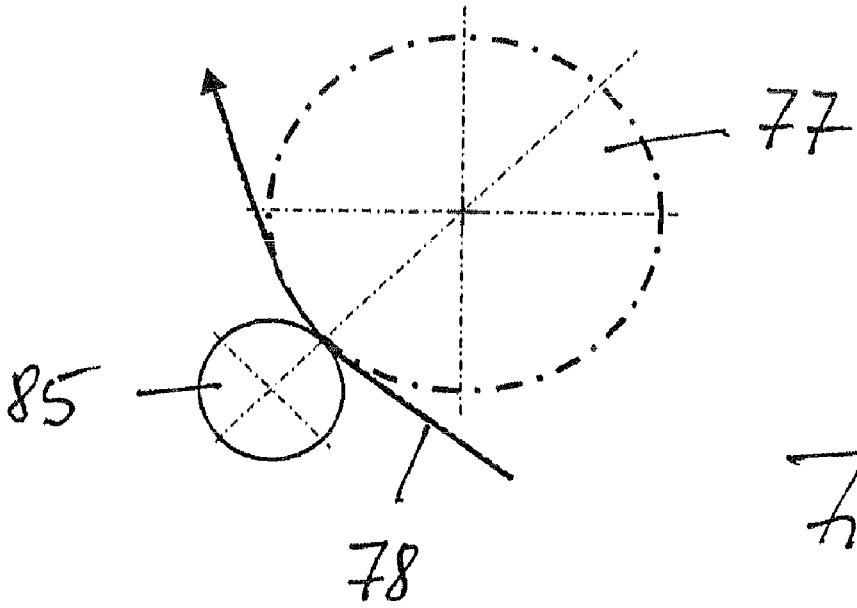
Figure 9B:
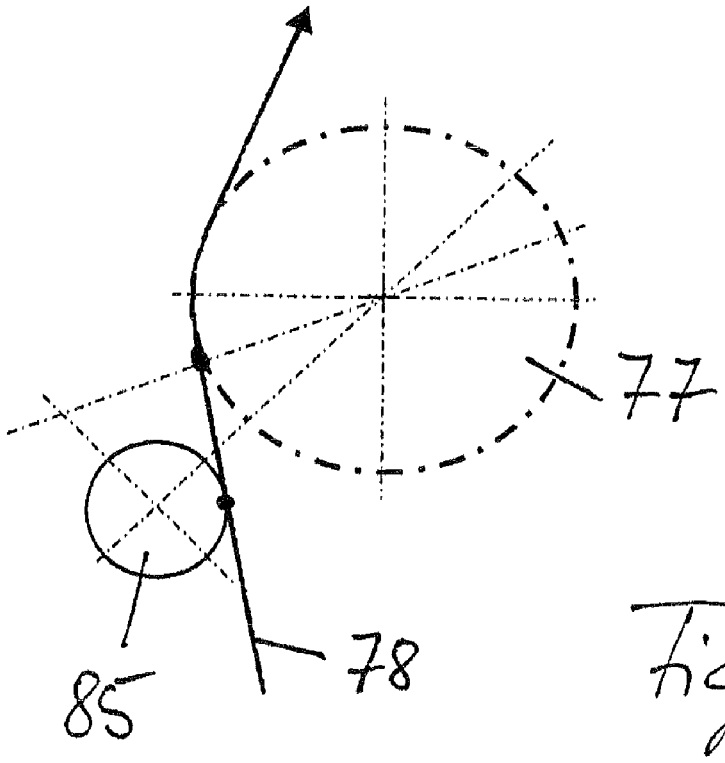
Figure 10A:
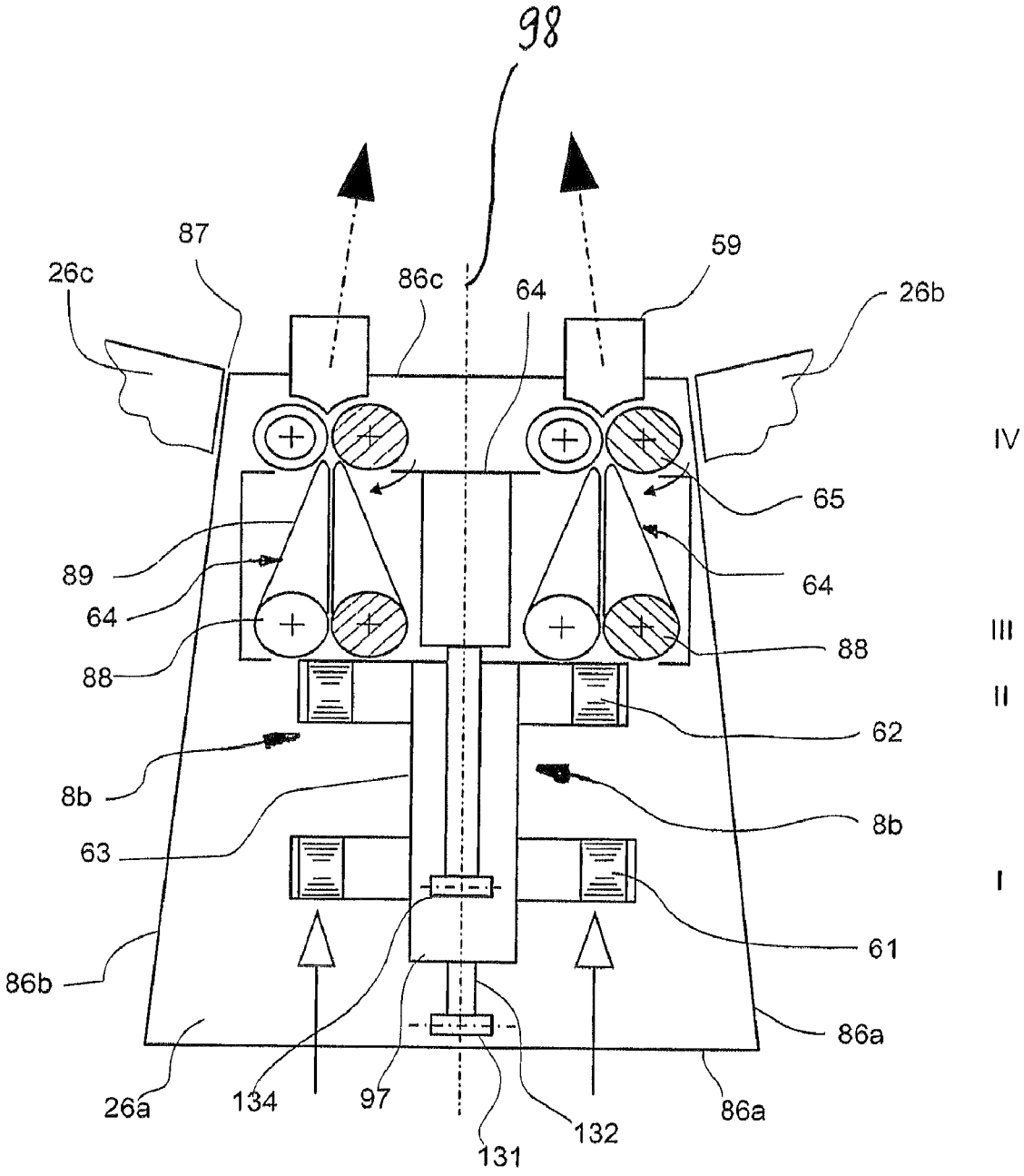
Figure 11A:
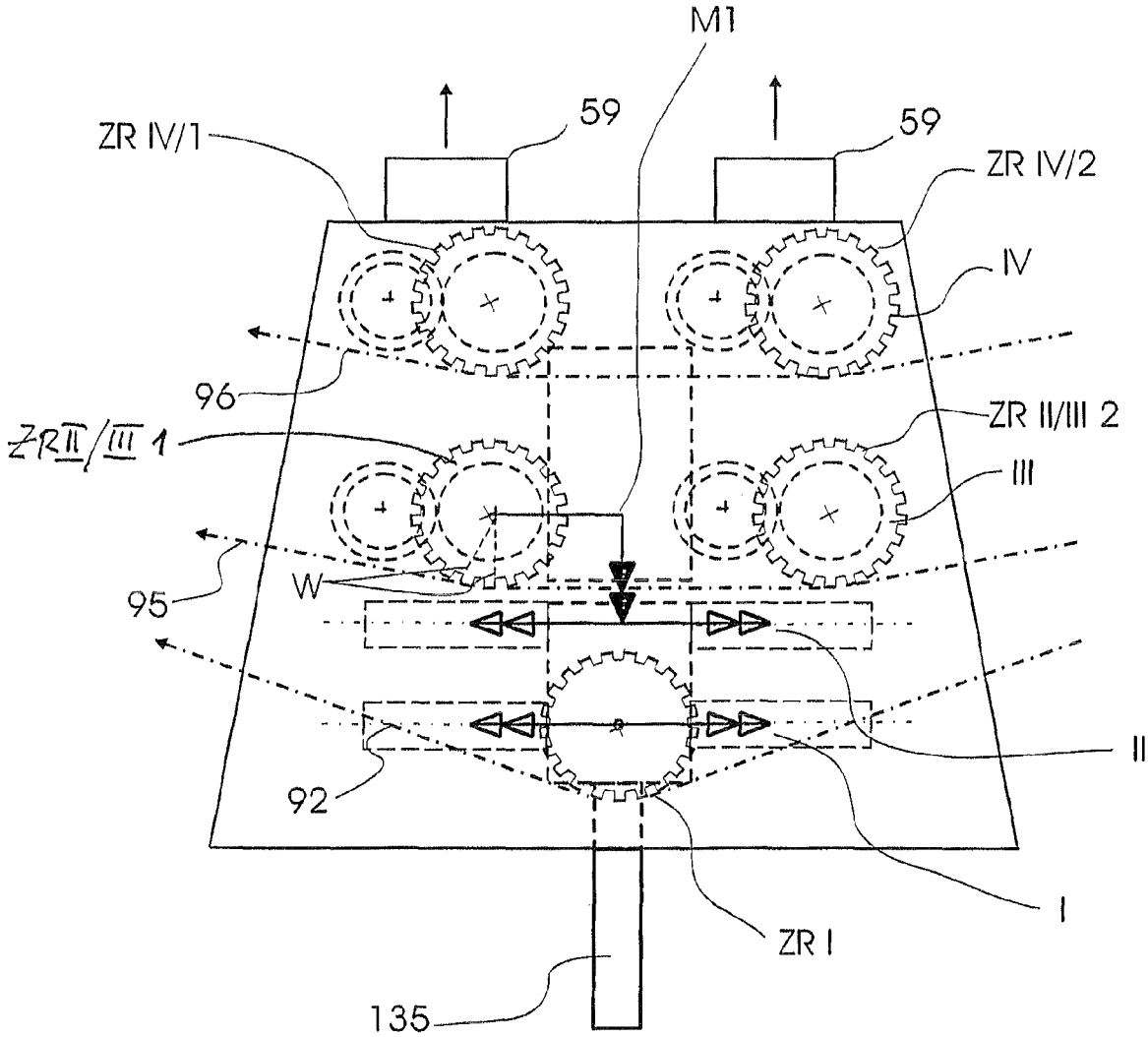
Figure 11B:
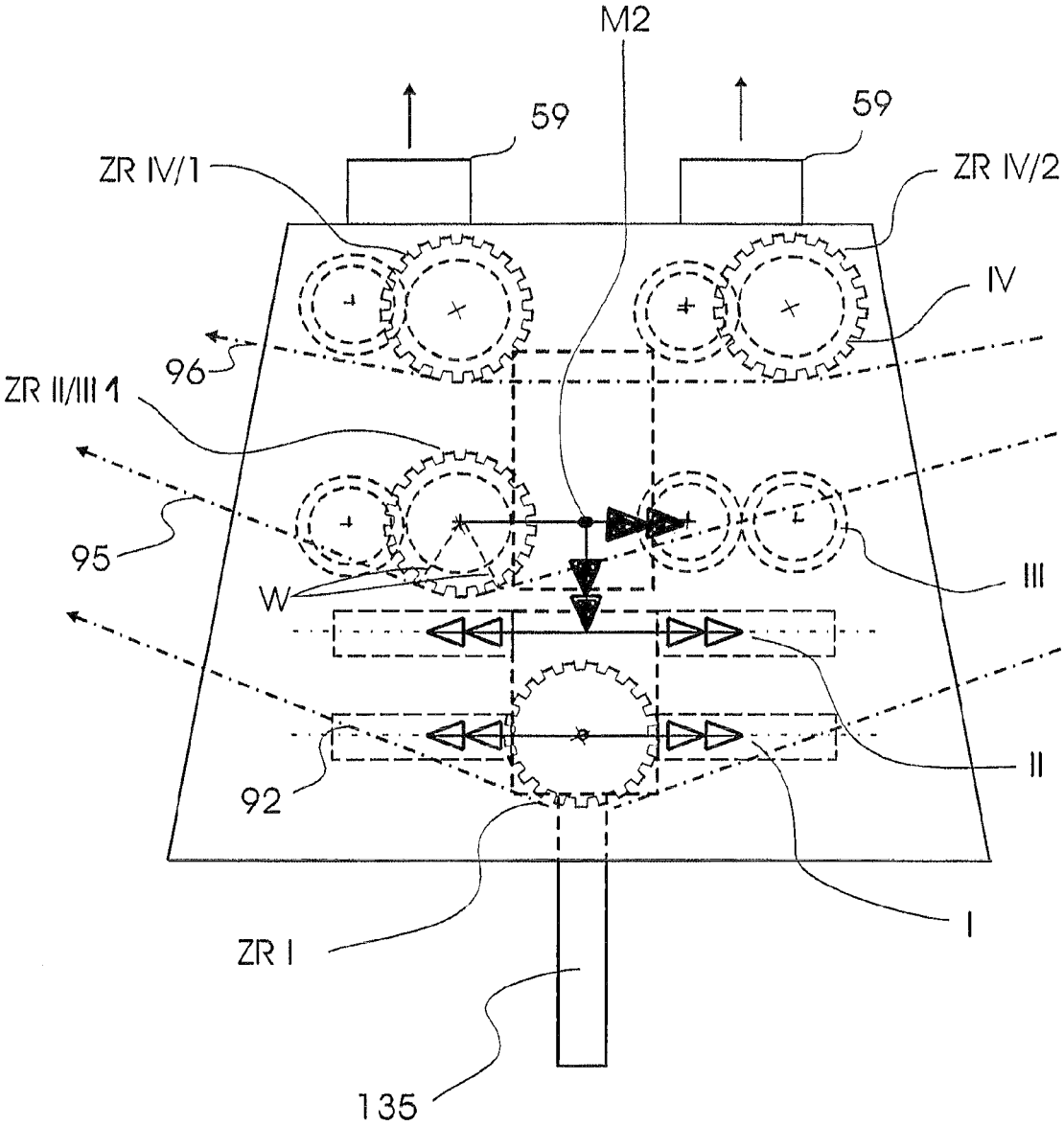
Figure 12A:
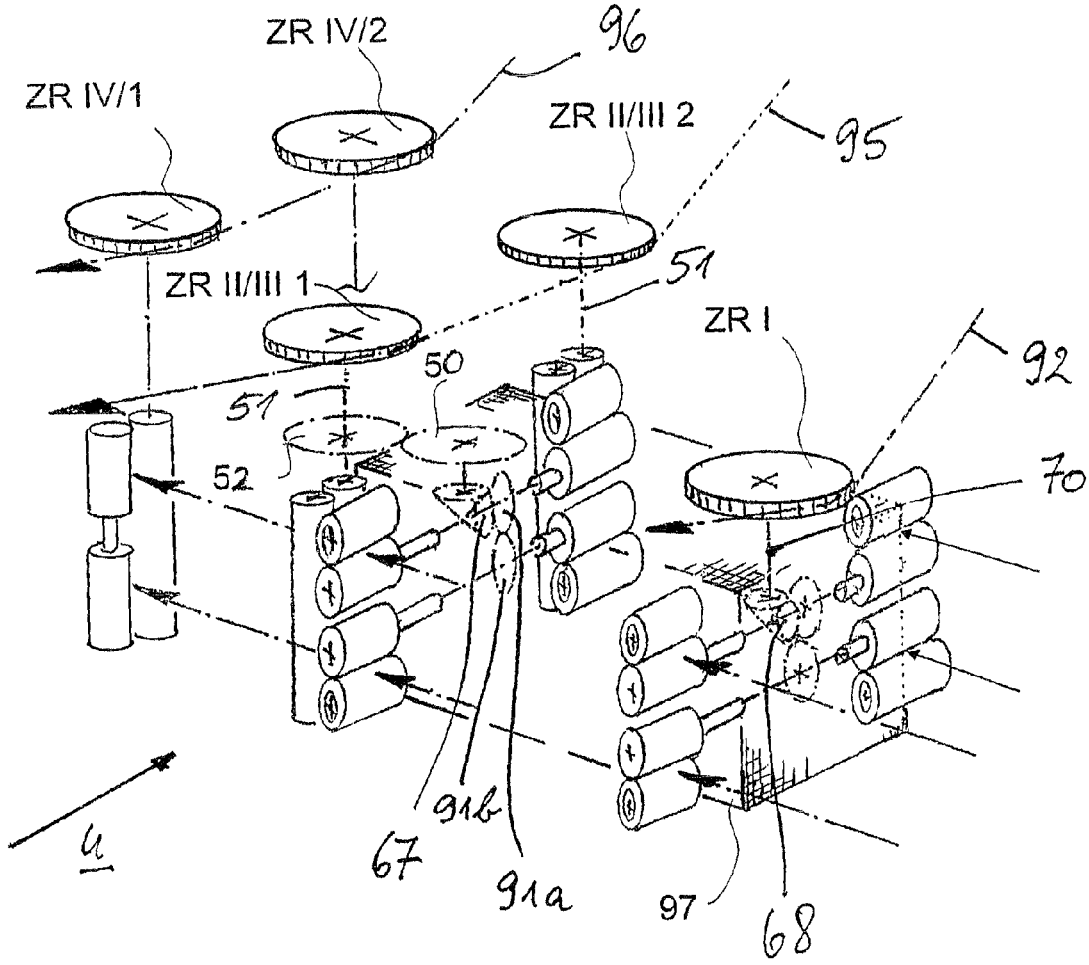
Figure 12B:
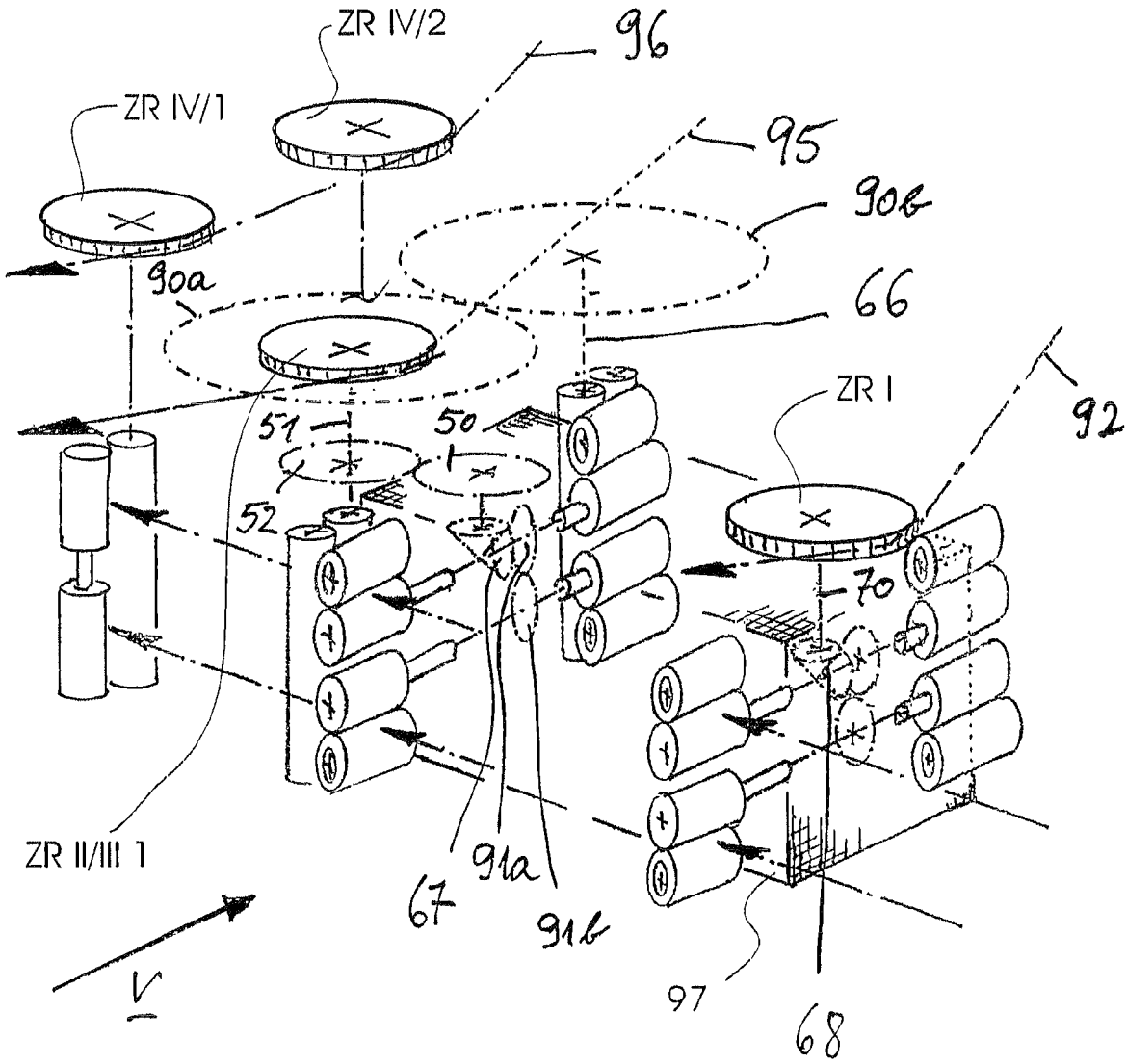
Figure 12C:
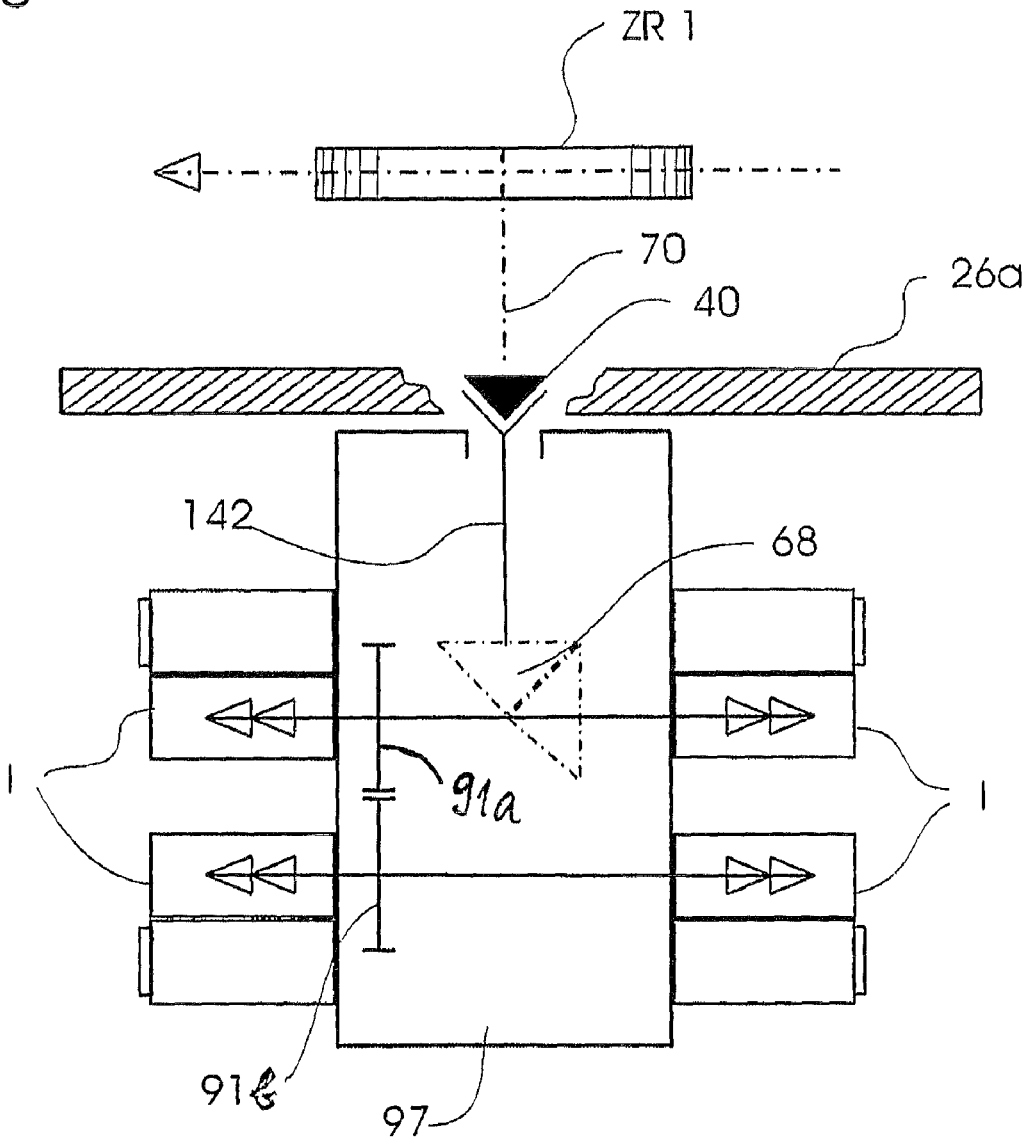

FIGS. 4, 5 and 6*a*, 6*b* show different types of drafting devices that can be connected to the partition wall according to FIG. 3;

FIG. 7*a* is a perspective view of a first embodiment of an insertion part for drafting device elements that can be connected to the partition wall according to FIG. 3;

FIGS. 7*b* and 7*c* show a second embodiment of the insertion part in a perspective view and a plan view;

FIG. 8 is a schematic plan view onto a drive unit in the form of a tangential belt drive according to the invention;

FIG. 9 shows a pulley of the tangential belt drive according to FIG. 8;

FIGS. 9*a* and 9*b* each show an auxiliary roller associated with the pulley according to FIG. 9;

FIG. 10*a* is a bottom view of a segment of the partition wall according to FIG. 3 looking at some drafting devices mounted thereon according to a first variant;

FIG. 11*a* is a schematic plan view onto the segment according to FIG. 10*a*, in which the drafting rollers and gear parts arranged vertically and below the segment are shown in dot-dash lines and the horizontal rollers have been omitted;

FIG. 12*a* is a schematic and perspective view of a drive unit and the gear parts according to FIG. 11*a* omitting the partition wall segment;

FIGS. 10*b* to 12*b* show views corresponding to FIGS. 10*a* to 12*a* according to a second variant;

FIG. 12*c* is the front view of a drive unit for a feed roller pair of the drafting device arrangements according to FIGS. 10*a* to 12*b;*

Figure 12D:
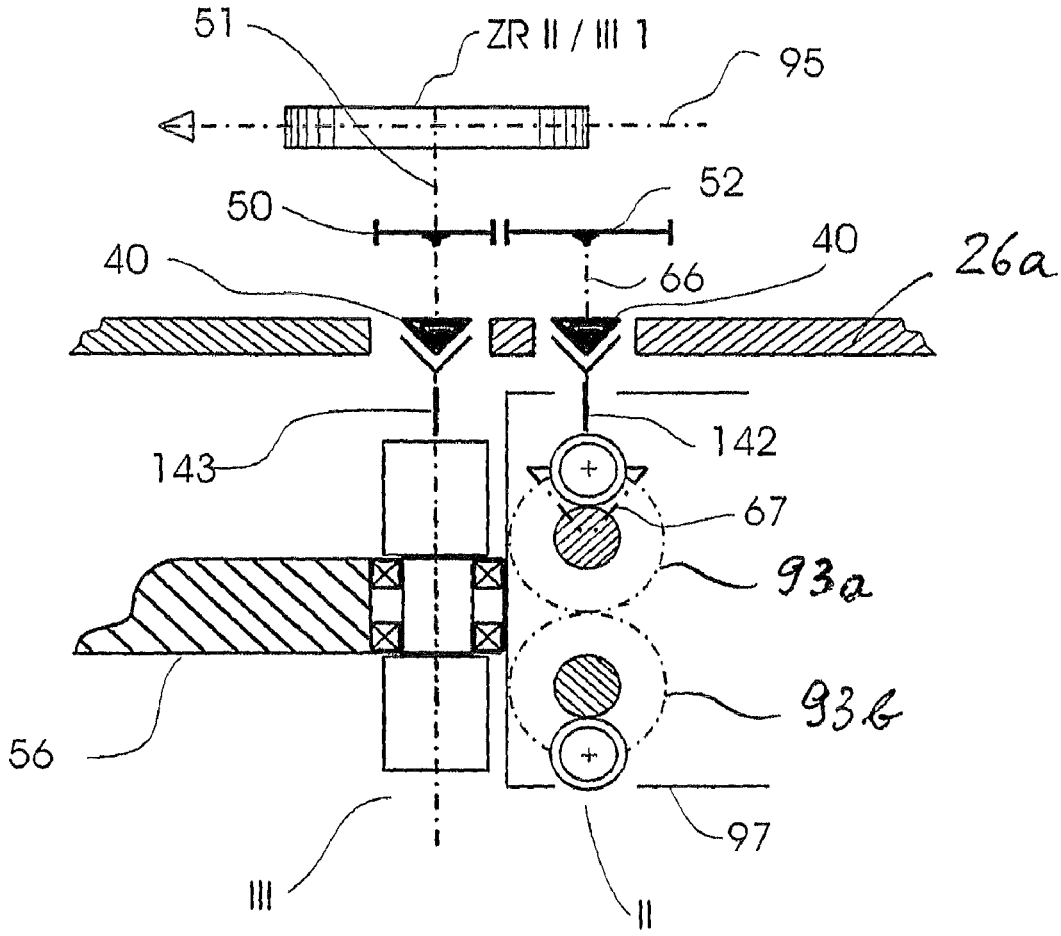

FIG. 12*d* is a side view of a drive unit for the drafting rollers of a folding zone of the drafting device arrangement according to FIGS. 10*a* to 12*a* in the direction of an arrow u in FIG. 12*a;*

Figure 12E:
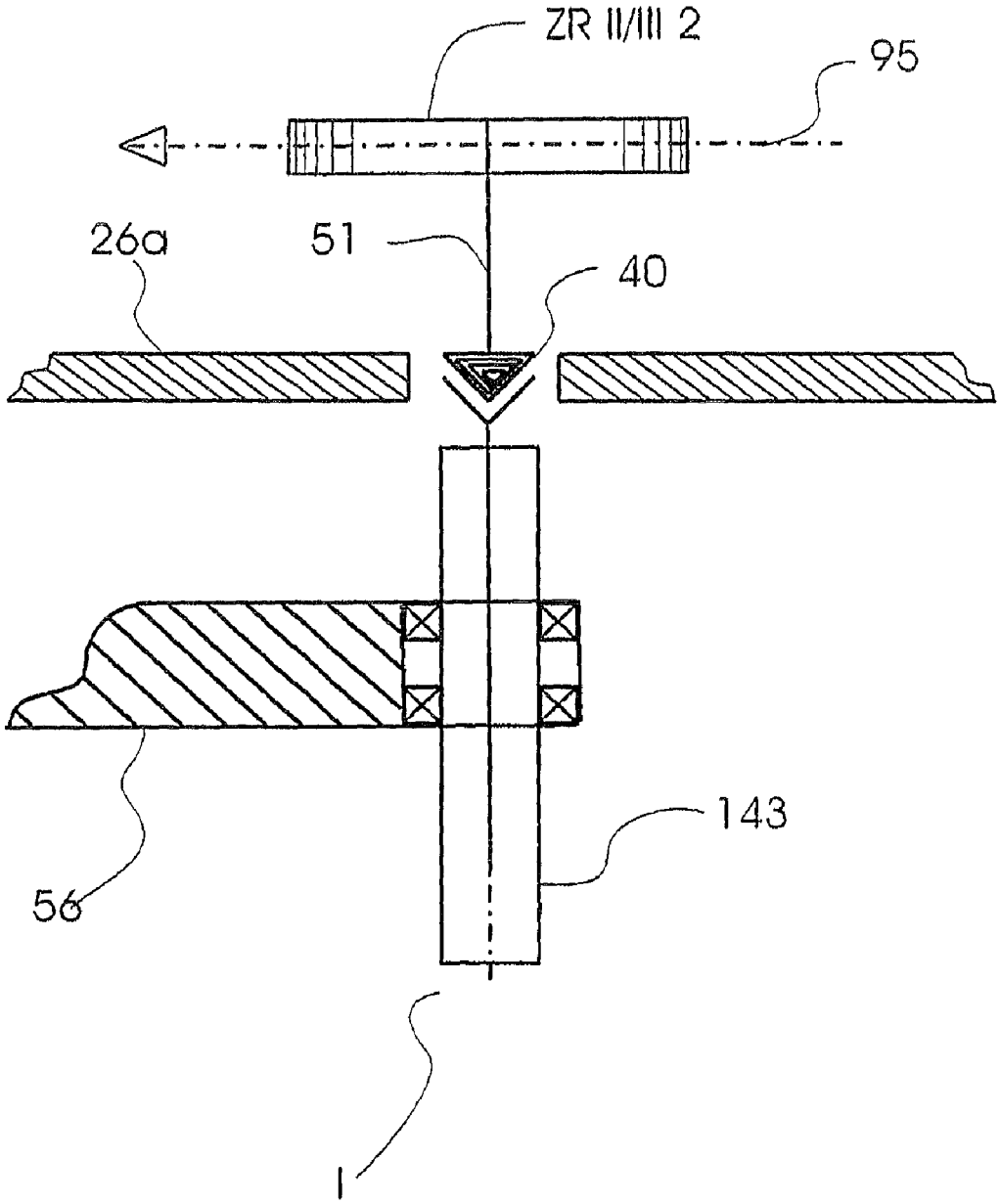

FIG. 12*e* is a side view corresponding to FIG. 12*d* of a drive unit for a further roller pair of the drafting device arrangement according to FIGS. 10*a* to 12*a;*

Figure 12F:
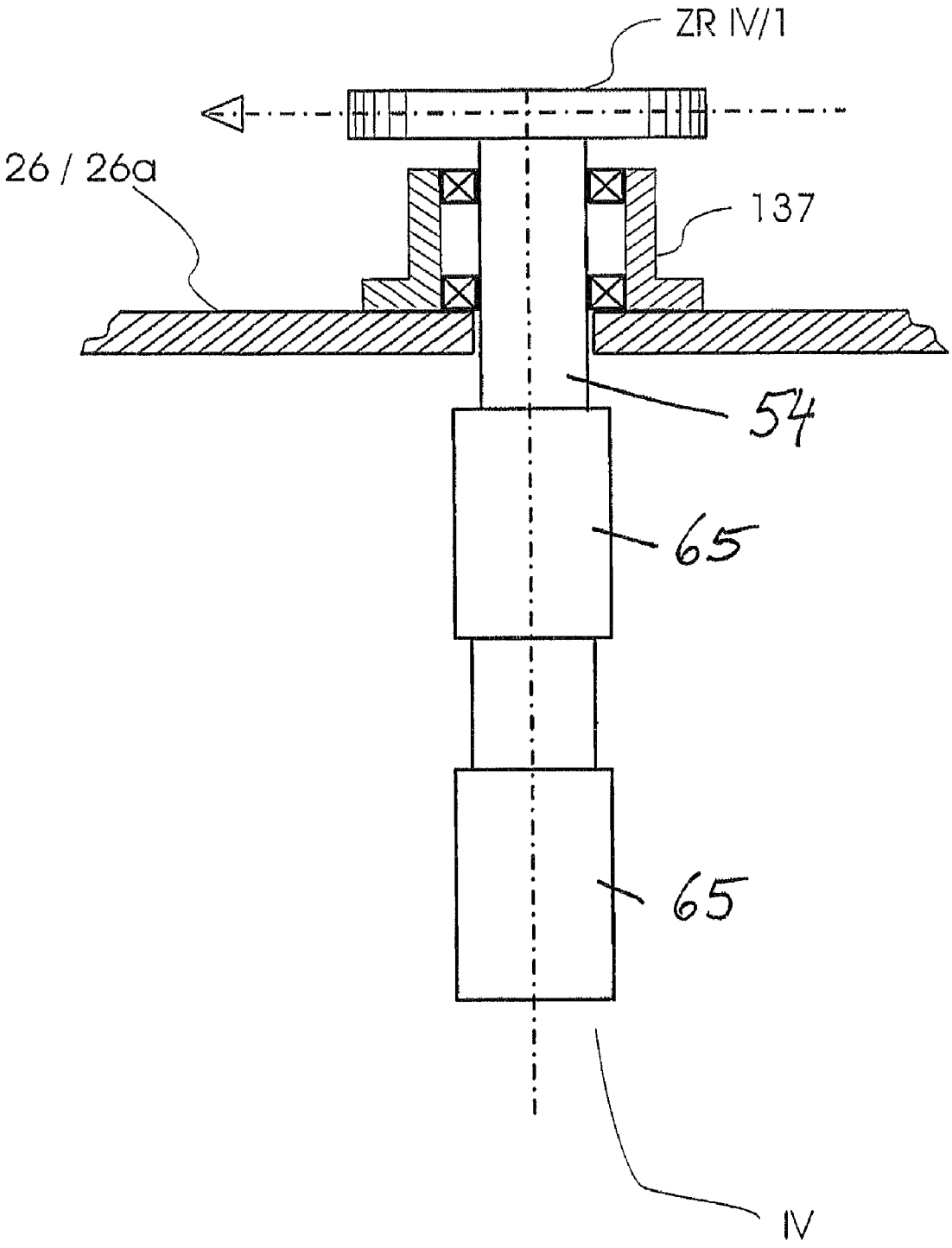

FIG. 12*f* is the front view of a drive unit for a withdrawal roller pair of the drafting device arrangements according to FIGS. 10*a* to 12*b;*

Figure 12G:
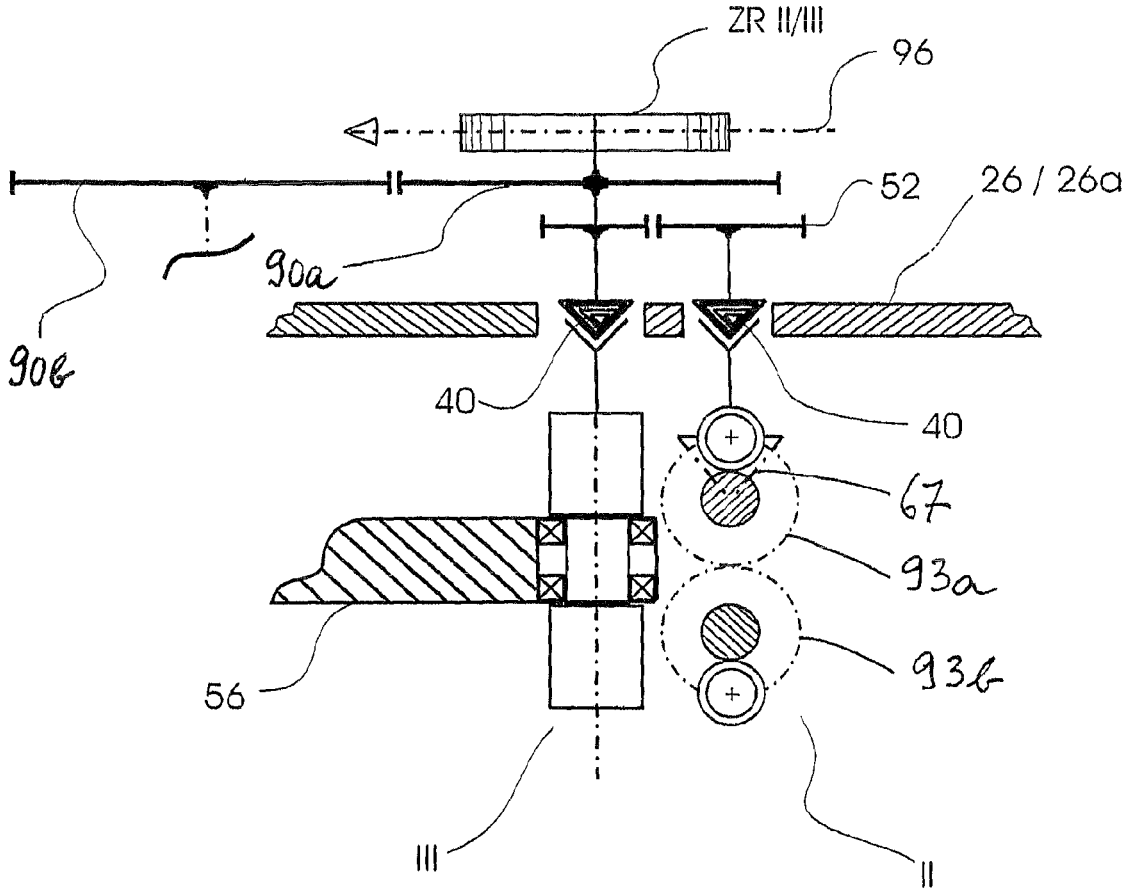
Figure 13:
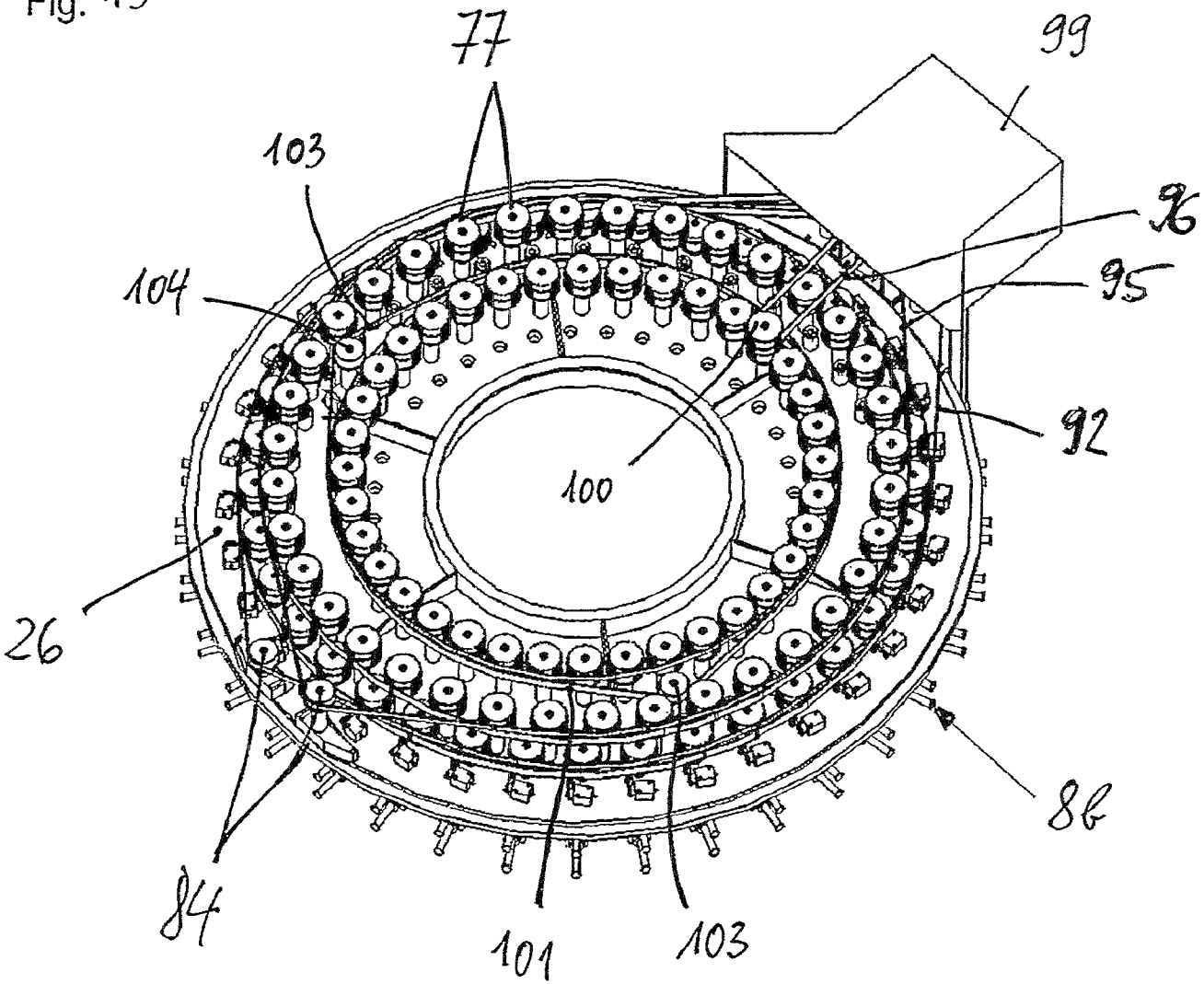
Figure 14:
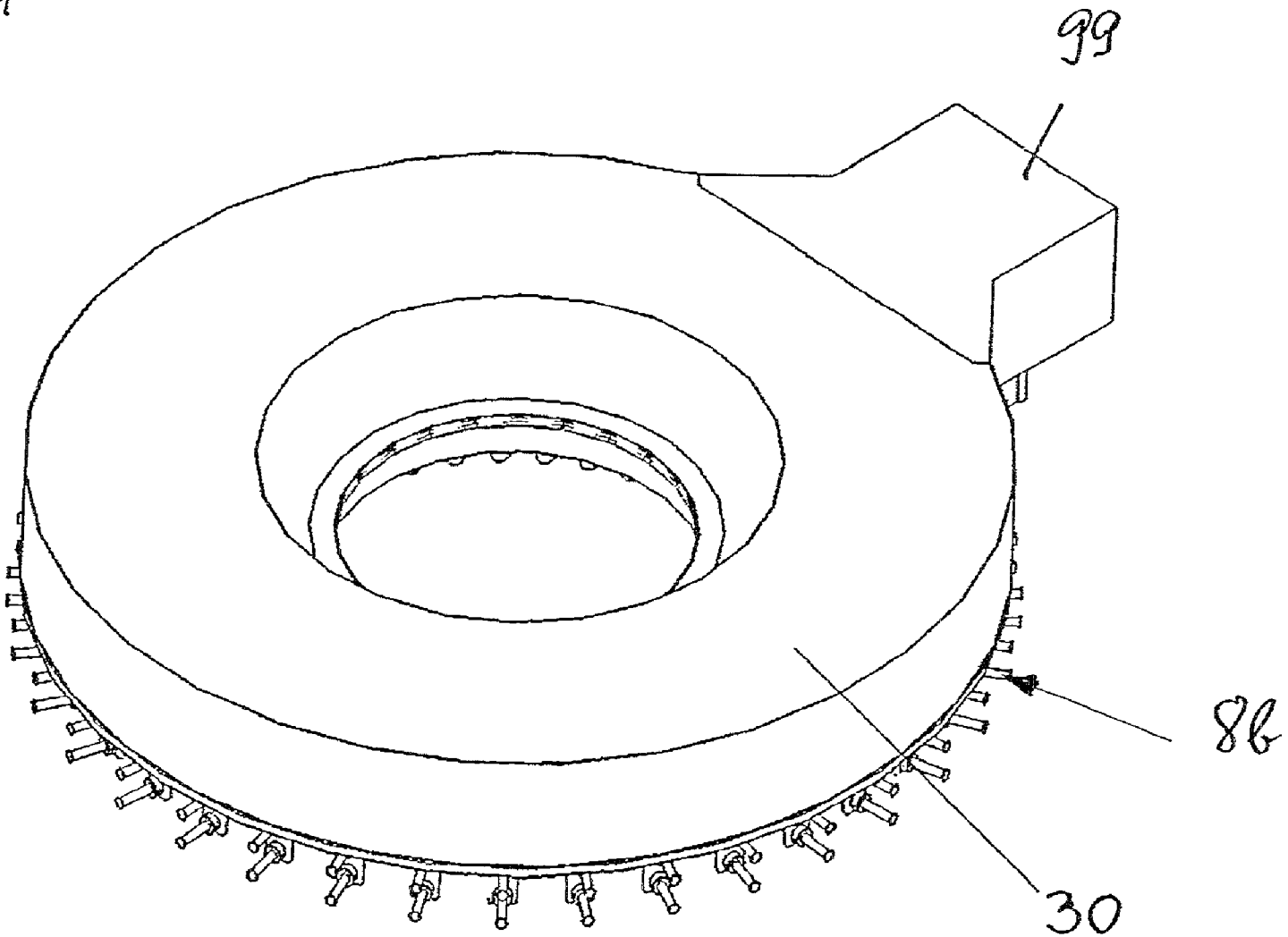
Figure 15:
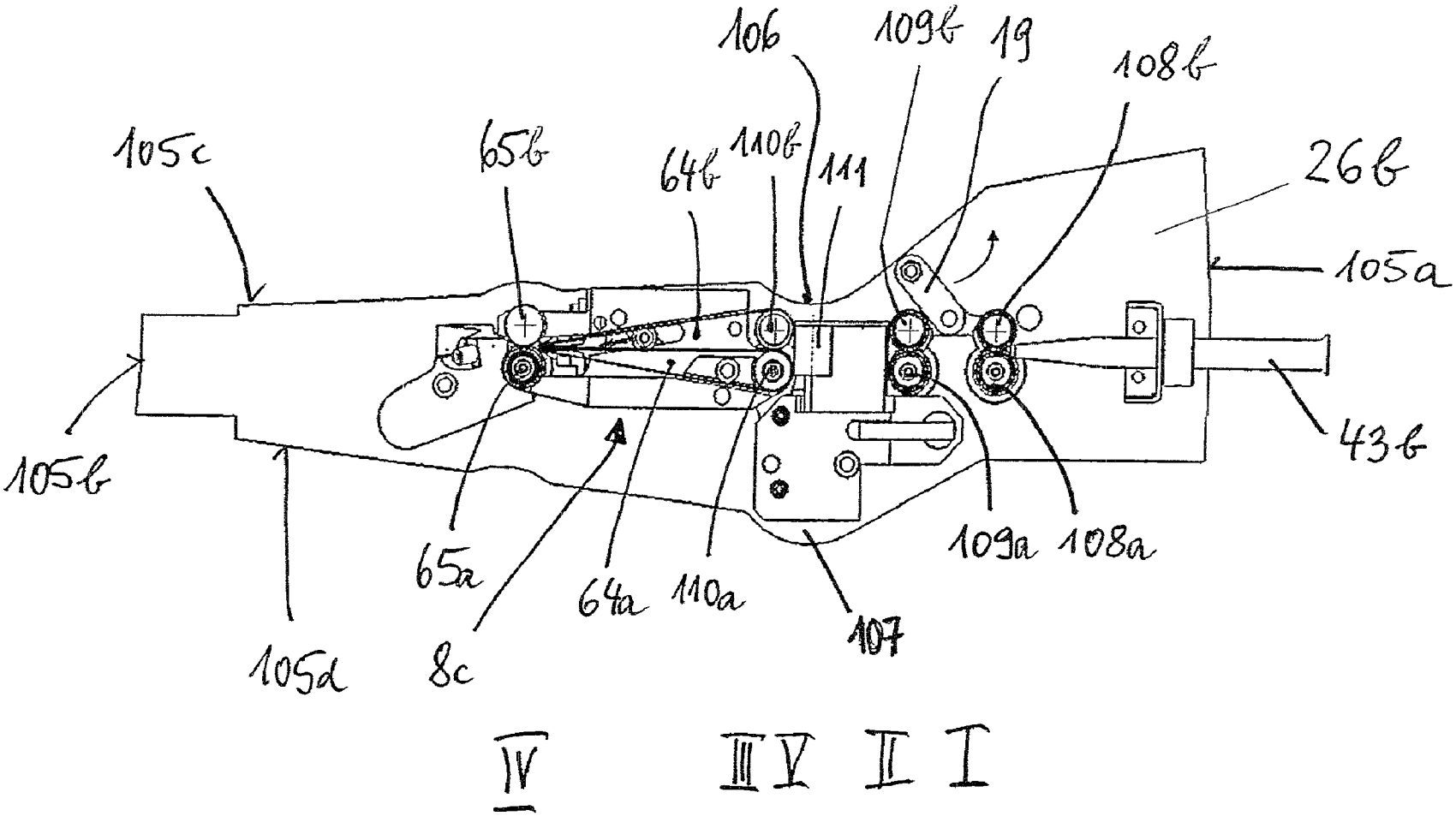
Figure 16:
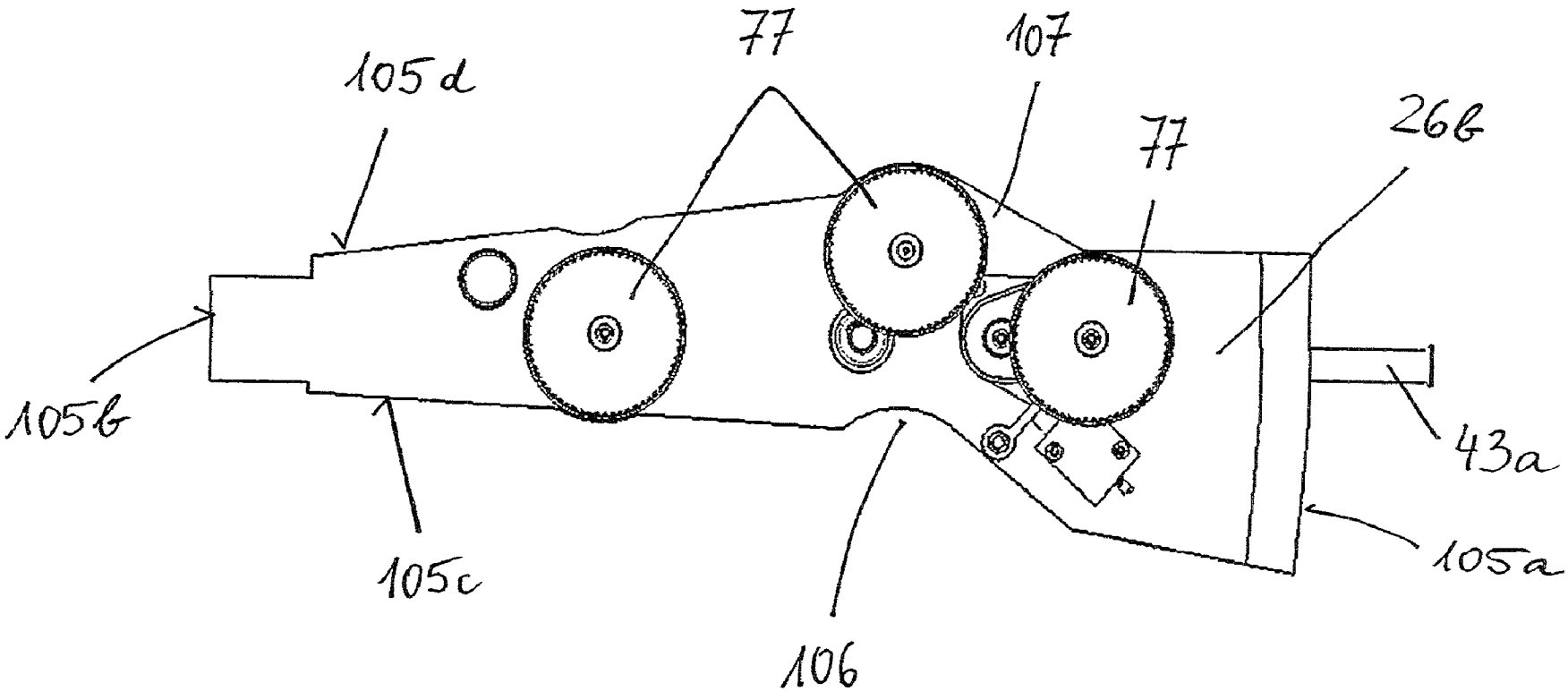
Figure 17:
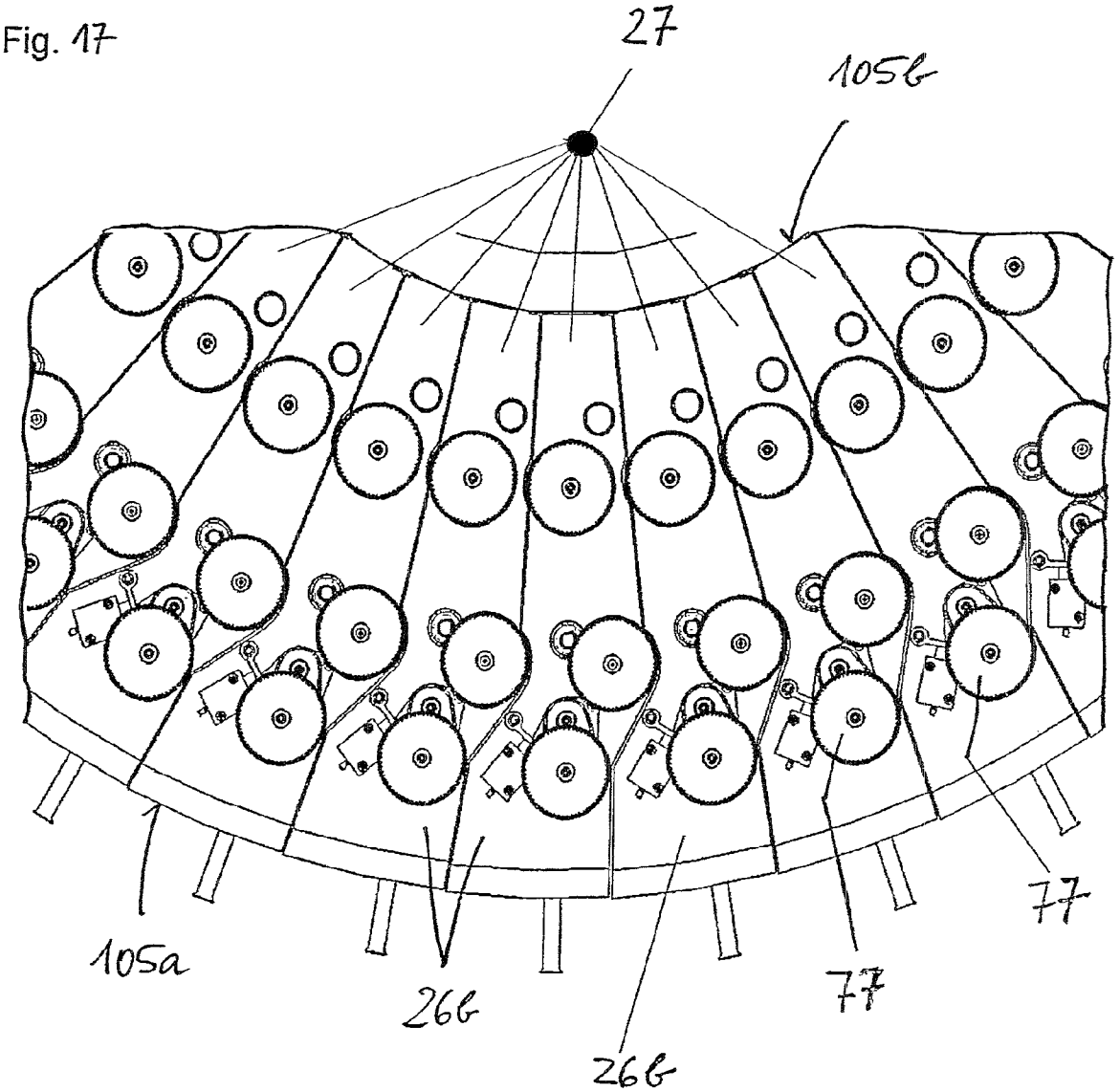
Figure 18:
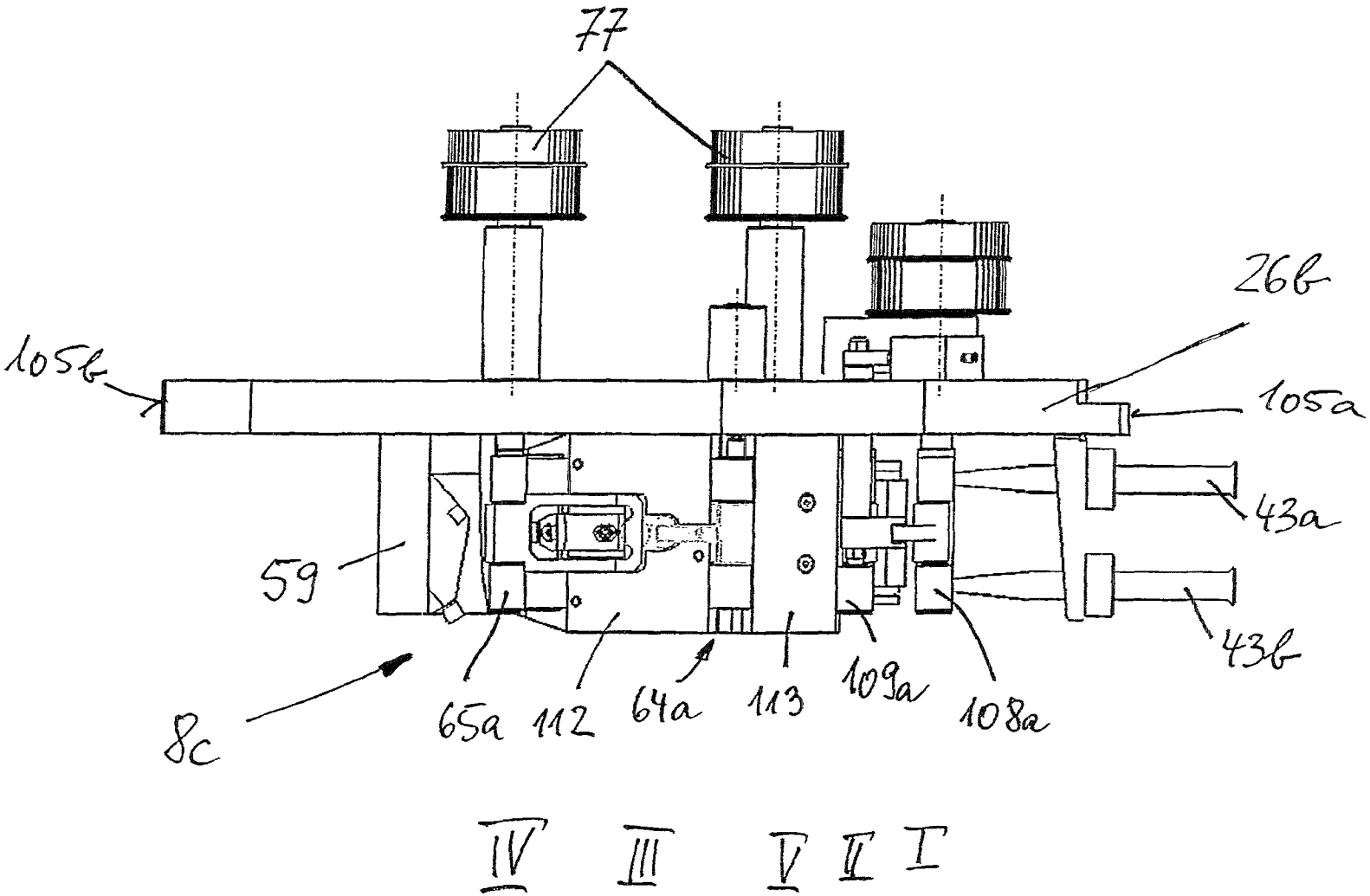
Figure 19:
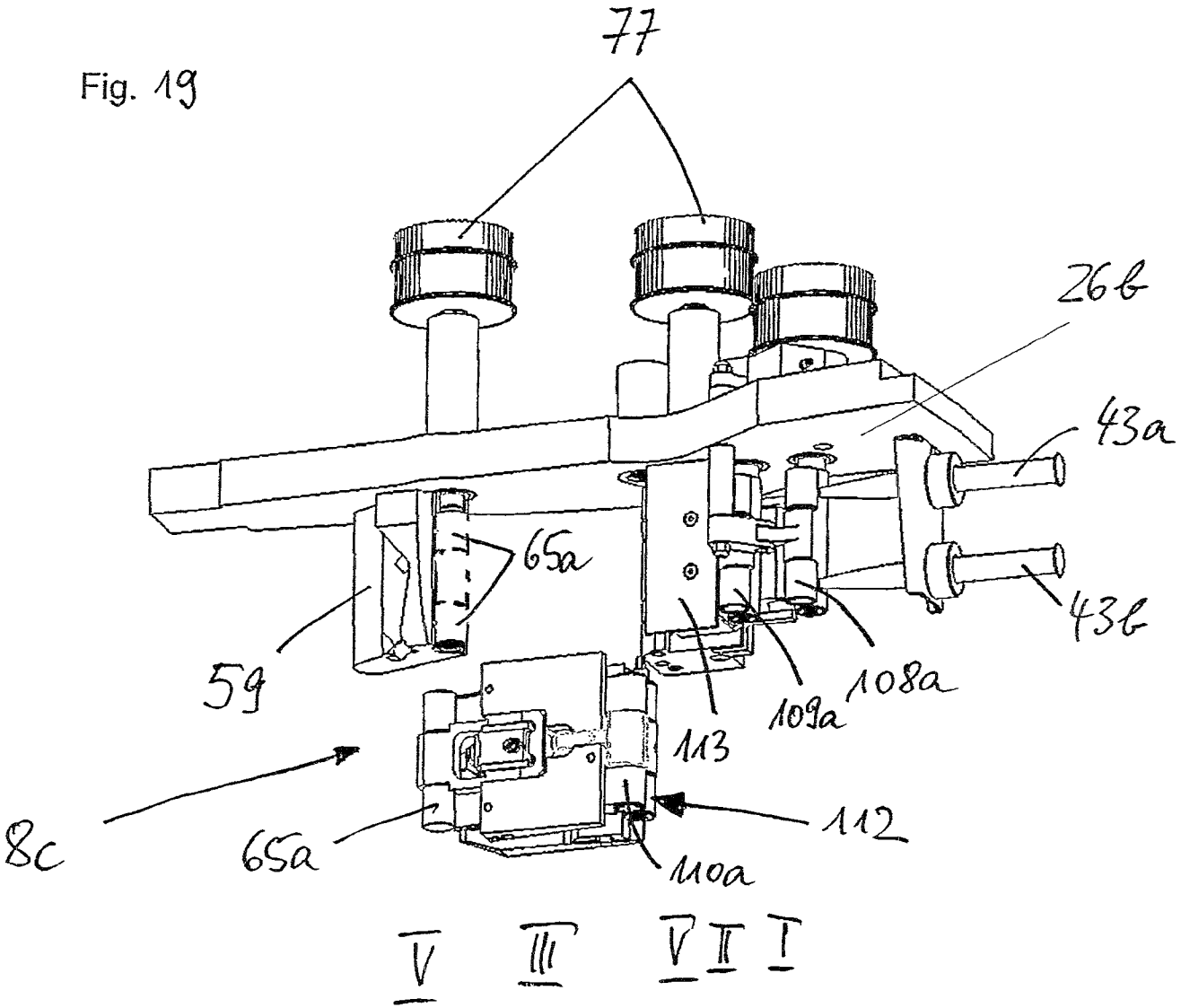
Figure 20:
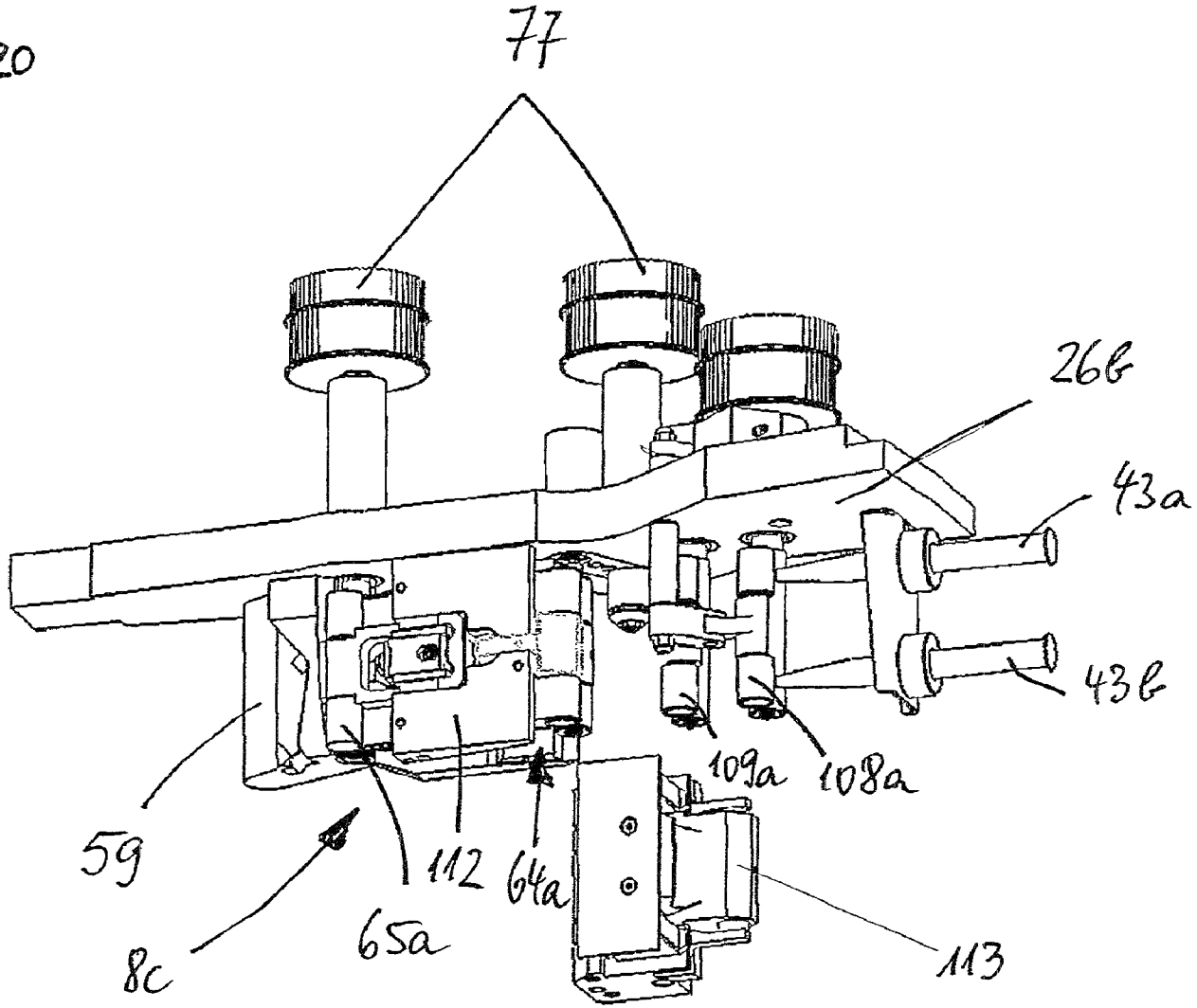
Figure 21:
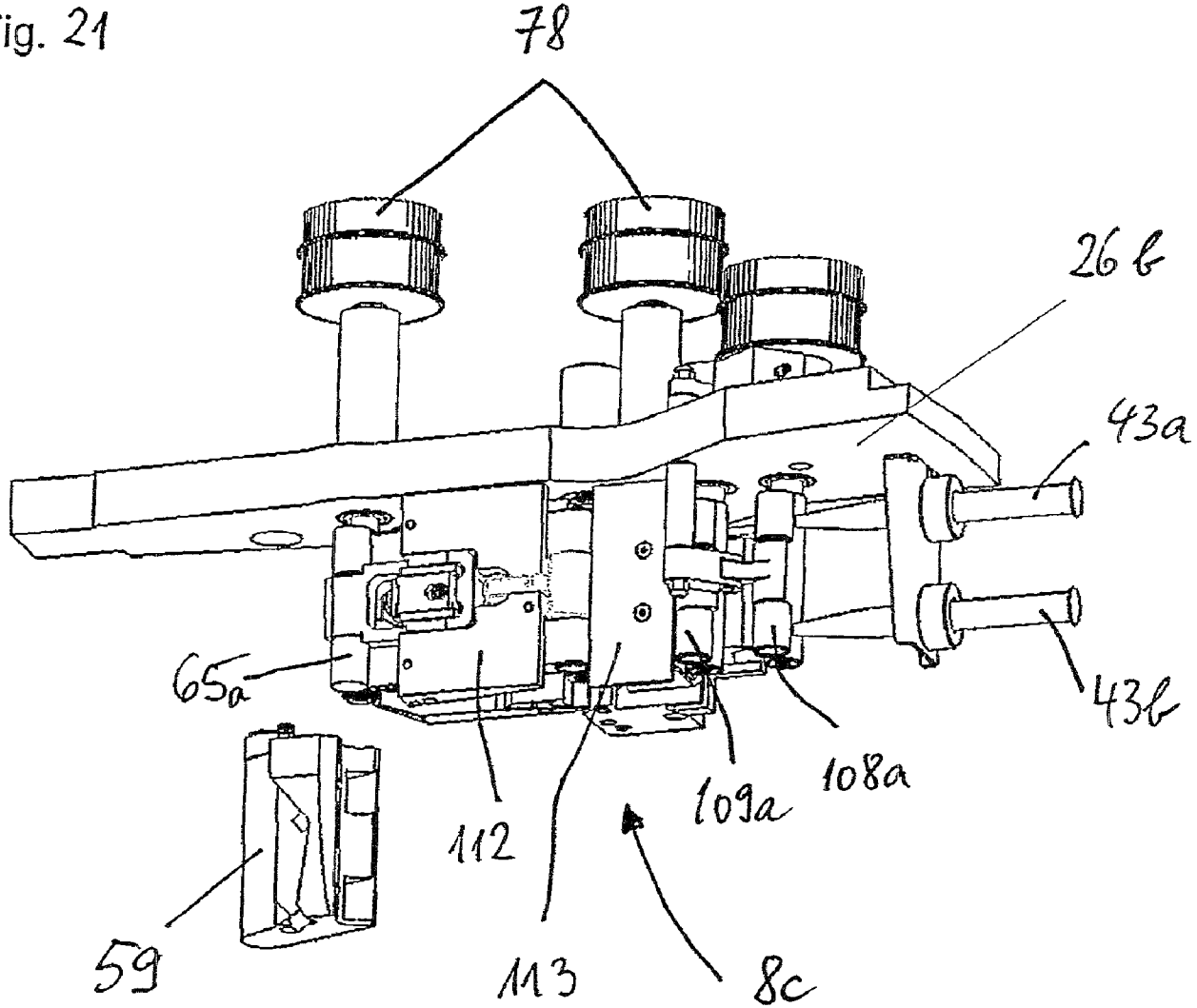
Figure 22:
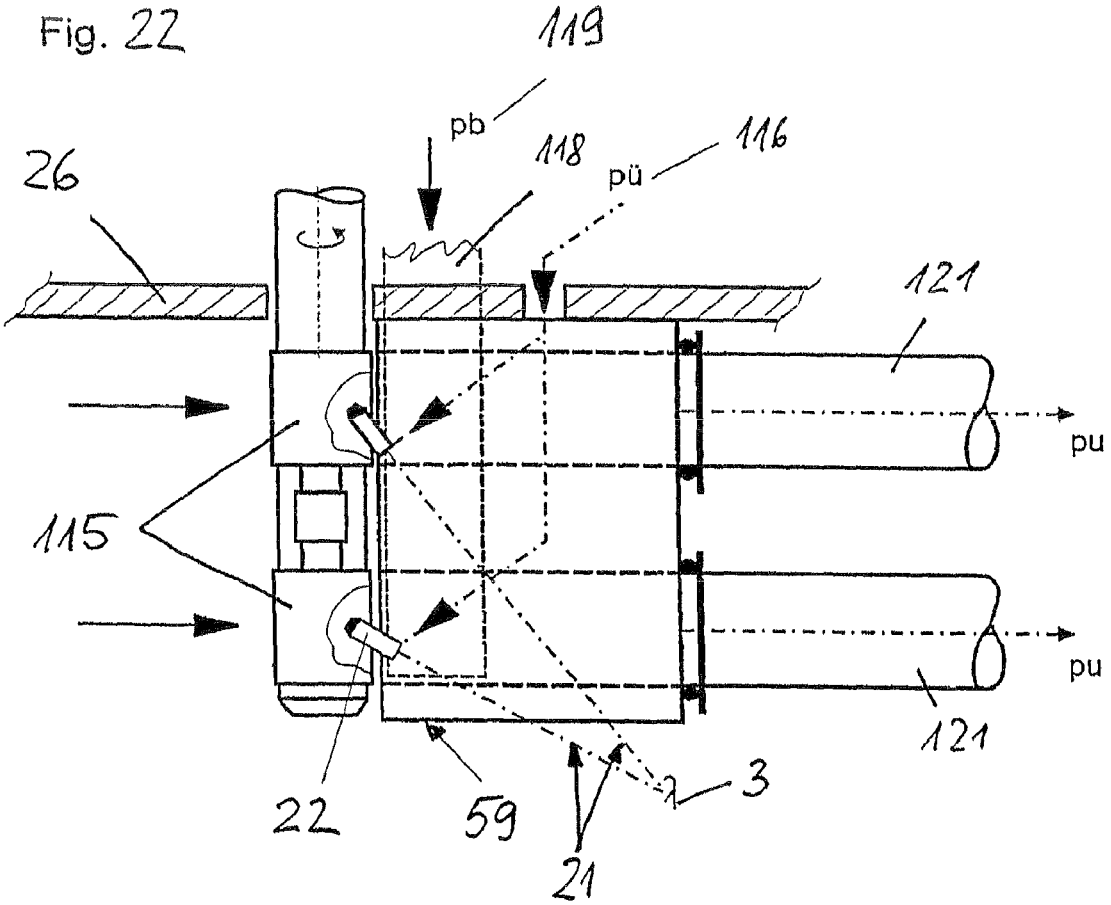
Figure 23:
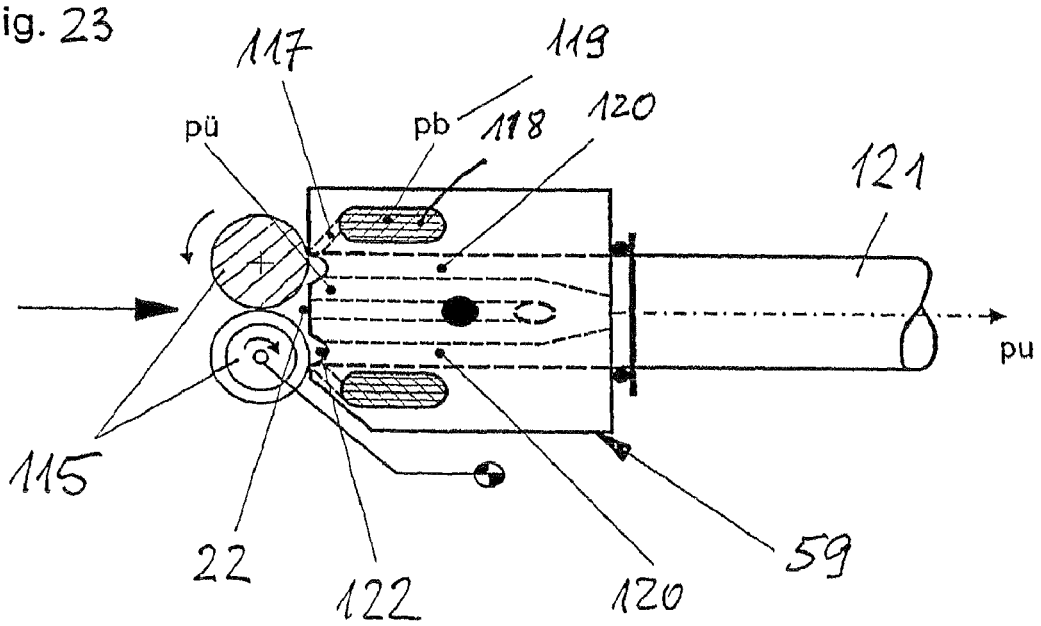
Figure 24:
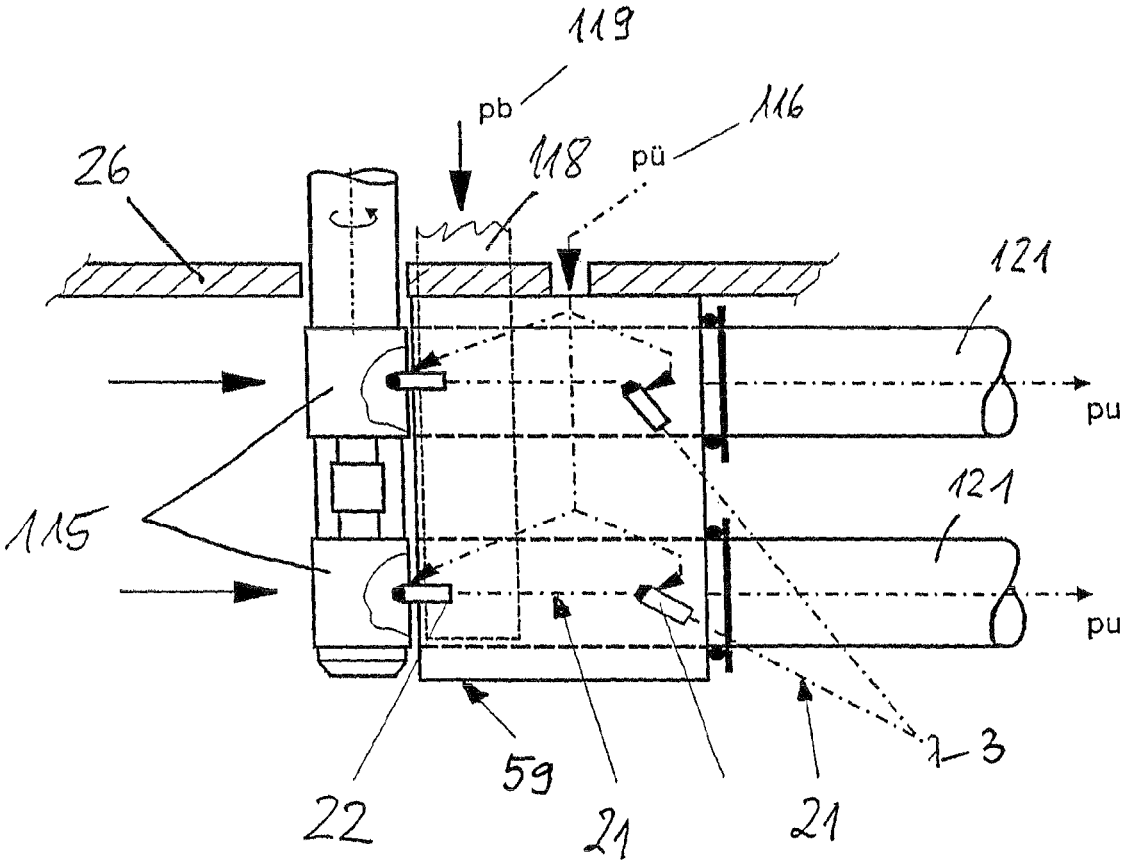

FIG. 12*g* is a side view of a drive unit for the drafting rollers of a folding zone of the drafting device arrangement according to FIGS. 10*b* to 12*b* in the direction of an arrow v in FIG. 12*b*, in which a not actually visible spur wheel is shown rotated 90° out of the plane of the drawing;

FIG. 13 is a perspective plan view onto a complete partition wall of the circular knitting machine according to FIG. 3 with drive units fastened thereon;

FIG. 14 is a view corresponding to FIG. 13, but after a covering that covers the drive units has been fastened on the partition wall;

FIGS. 15 and 16 are respectively a bottom view and a plan view of a second exemplary embodiment of a partition wall segment according to the invention with drafting device parts mounted thereon;

FIG. 17 is a plan view onto a multiplicity of adjacent segments according to FIGS. 15 and 16;

FIG. 18 is a side view of a partition wall segment according to FIGS. 15 and 16;

FIGS. 19 to 21 respectively show a perspective view of the partition wall segment according to FIG. 18 with three insertion parts, one of which in each case is located in a removed state from the partition wall segment;

FIGS. 22 and 23 respectively show a side view and a plan view of a nozzle assembly connected to the partition wall according to FIG. 3; and FIG. 24 is a side view of a second exemplary embodiment of the nozzle assembly.

Figure 1:
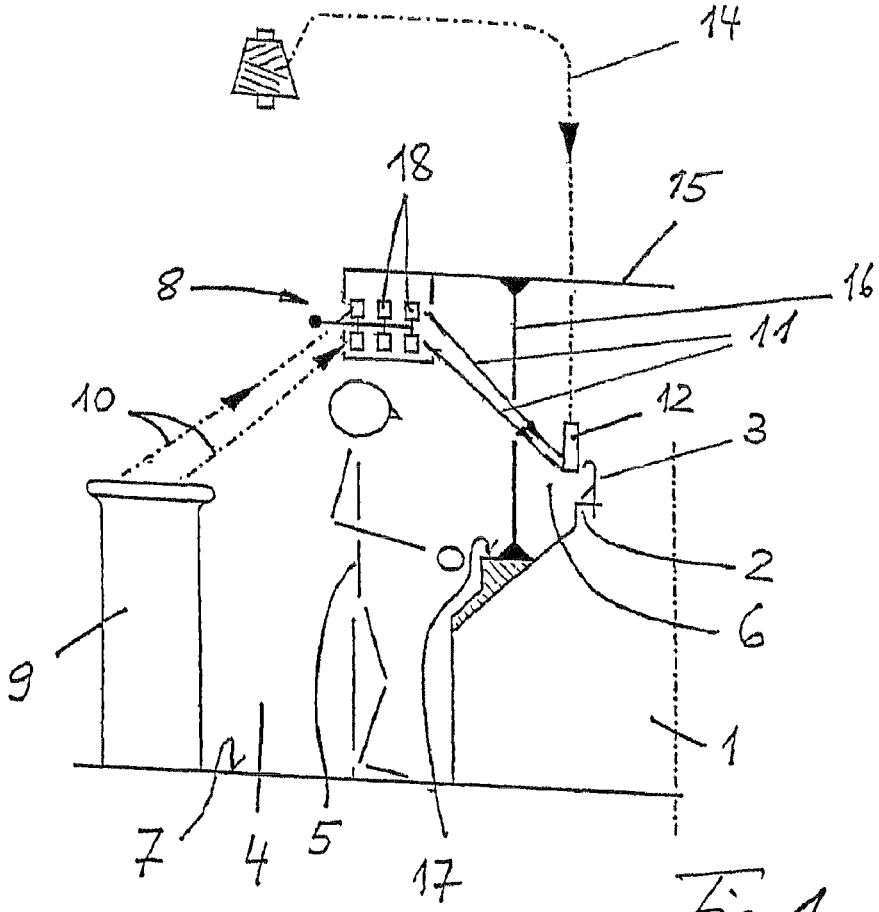
FIG. 1 shows a schematic vertical section through an already proposed circular knitting machine for the production of knitted goods by at least partially using fibre materials.
Figure 2:
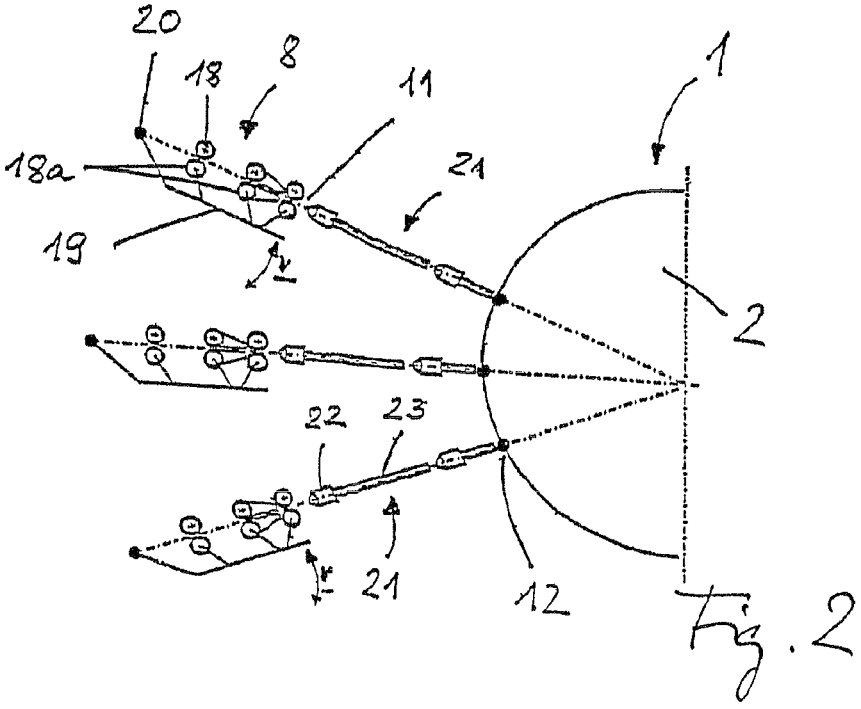
FIG. 2 is a plan view onto the circular knitting machine according to FIG. 1 with the omission of an auxiliary thread and with the inclusion of spinning devices.

FIGS. 1 and 2 schematically show a circular knitting machine 1 with a rotatable needle cylinder 2, in which knitting needles 3 are displaceably disposed. In front of the circular knitting machine 1 or in a region surrounding this, a work area 4 is schematically indicated, in which an operator 5 is positioned during normal work on the circular knitting machine 1. The height of the circular knitting machine 1 is usually dimensioned so that a plurality of stitch-forming or knitting systems 6, which are formed from cam parts (not shown) and only one of which is shown in FIG. 1, lie within the reach of the operator 5. The term "reach" is to be understood to mean the region that is preferably arranged at a particularly ergonomically favourable distance above the ground 7 or the like, on which both the circular knitting machine 1 and the operator 5 stand.

The circular knitting machine 1 of interest within the framework of the present invention is configured as a so-called spinning-knitting machine. Each knitting system 6 has an associated drafting device 8, to which a sliver removed from a can 9, a flyer frame sliver removed from a supply coil or any other fibre material 10 is fed. This fibre material 10 is attenuated to a thread 11 in the drafting device 8 in a manner known per se and is preferably fed by means of a thread guide 12 to the knitting needles 3 for stitch formation. In addition, an auxiliary thread is given the reference 14 and can also be fed to the thread guide 12, in particular if the knitted fabric is to be additionally provided, for example, with a plating thread or an elastic thread.

Stitch-forming machines of the described type are known to the person skilled in the art e.g. from the aforementioned publication PCT WO 2004/079068 A2, which is herewith incorporated into the subject of the present disclosure by reference to avoid repetition.

According to a further older proposal from the same applicant (PCT WO 2007/0931-66), the drafting devices 8 are arranged so that, like the knitting systems 6, they lie within the reach of the operator 5 working on the circular knitting machine 1, but above him/her. For this purpose, the drafting devices 8 are fastened to a support ring 15, for example, which is supported on a base or cam plate 17 of the circular knitting machine 1 by means of columns 16. Moreover, the arrangement is such that the nip lines formed by three or more pairs of drafting rollers 18 of the drafting devices 8 lie in vertical planes. This is achieved by arranging the axes of the drafting rollers 18 vertically in an installed or used state. In order to ensure that the drafting devices 8 are not only reachable for the operator 5 from the work area 4, but can also be easily maintained and/or repaired without having to be fully dismantled, the drafting devices 8 can be at least partially opened by fastening their so-called top rollers 18*a* (FIG. 2) to a press arm 19, which, in contrast to the conventional technique, lies on the side instead of at the top and can be pivoted in the direction of an arrow v around a vertical pivot axis 20 indicated by way of example.

To enable the threads 11 to be securely inserted into the knitting needles 2, even if the drafting devices 8 according to FIG. 2 are spaced at a greater distance from the periphery of the needle cylinder 2, additional spinning devices 21 are preferably provided between the drafting devices 8 and the thread guides 12 according to FIG. 2. As is known from the specified publications, these spinning devices 21 include, for example, at least one respective spinning nozzle in the form of a twist element 22 and a spinning tube or transport tube 23 connected to this. The purpose of the spinning devices 21 is to firstly convert threads 11 discharging from the drafting devices 8 into temporary yarns with genuine twists, which are released again between the ends of the spinning tubes 23 and the knitting systems 6 because of the so-called false twist effect.

Since the drafting rollers 18 stand perpendicular, they can be driven in a simple manner by drive belts arranged in a circle extending in peripheral direction of the needle cylinder 2. All that is necessary for this is to provide the shafts of each so-called bottom roller of the three roller pairs shown with a respective toothed pulley, for example, at their upper ends, as is explained further below.

Finally, it is particularly advantageous according to the exemplary embodiment of FIGS. 1 and 2 to arrange two or also more drafting devices 8 with their rollers 18 coaxially one above the other. As a result of such a multiple or double or tandem design, it is possible to halve the space required for the drafting devices 8 in the peripheral direction or reduce this still further, since in this case two or more threads can be guided to the adjacent knitting systems 6 from each drafting device segment, as is indicated in FIG. 1 by two threads 11. As a result of this, the package density of the drafting devices can be doubled or multiplied.

FIG. 3 shows a circular knitting machine that, like the circular knitting machine 1 according to FIGS. 1 and 2, can also have a second needle line, as is indicated schematically by additional knitting needles 25 arranged in a dial, for example. Unless stated otherwise, the same parts are given the same references in FIG. 3 as in FIGS. 1 and 2.

According to the invention, instead of the support ring 15 or in addition thereto, the circular knitting machine 1 according to FIG. 3 has a partition wall 26, which is arranged transversely and preferably perpendicular to a machine axis 27, at the same time forming the rotational axis of the needle cylinder 2 (FIG. 1) and generally extending vertically, and is expediently arranged coaxially to this machine axis and configured in the shape of a panel, for example. As will be explained more precisely, the drafting devices 8 are distributed around the machine axis 27 below the partition wall 26, whereas above the partition wall 26 drive units 28 necessary to drive the drafting rollers and, if required, also elements of a blower and suction system for the drafting rollers for fluff removal and/or of a nozzle assembly for the spinning devices are arranged. The partition wall 26 is configured and/or arranged so that it causes a fibre-tight separation of the drive units 28 from the drafting devices 8, wherein the term "fibre-tight" is understood to mean that the fibres, fluff, dirt particles etc. generated by the drafting devices 8 are substantially kept away from the drive units 28 as a result of the partition wall 26 and cannot pass through openings provided in the partition wall 26 to the drive units 28. The partition wall 26 therefore preferably covers all the drafting devices present with its projection. Moreover, the partition wall 26 is at the same time a mounting wall for the mentioned structural elements, but for reasons of simplicity will only be referred to hereafter as a partition wall.

The partition wall 26 is fastened to a machine frame of the circular knitting machine containing the base or cam plate 17 (FIG. 1), for example, in a manner not shown in more detail. In a similar manner to FIG. 1, a plurality of support columns distributed around the machine axis 27 preferably project from the base plate 17 and support a support ring, to which the partition wall 26 or a multiplicity of segments thereof is fastened. Alternatively or additionally, in a region radially removed from the machine axis 27 the partition wall 26 can be supported on the ground 7 by means of further support columns 29 in order to thus better absorb the weight of the drafting devices 8 and drive units 28 fastened to it. Otherwise, the partition wall 26 can be configured in one piece and, for example, as a preferably circular panel arranged coaxially to the machine axis 27, as a ring, in particular circular ring, arranged coaxially to the machine axis 27 or be conical in configuration.

A partition wall 26 arranged on an angle to the machine axis 27 is also possible. However, alternatively it is also possible to assemble the panel or the ring from a multiplicity of segments surrounding the machine axis 27 and abutting against one another in a fibre-tight manner, these preferably being identically configured and each supporting an associated drafting device 8 or an associated drafting device arrangement. For reasons of simplicity, all these possible exemplary embodiments are described and claimed by the expression "transversely to the machine axis".

As FIG. 3 additionally shows, the partition wall 26 is preferably provided on its upper side with a preferably hood-like covering 30, which is fastened to it in a fibre-tight manner and with it forms a ring-shaped fibre-tight sealed housing to receive the drive units 28, so that these cannot be fouled by fibres flying around inside or outside the partition wall 26. If the partition wall 26 is ring-shaped, the covering 30 can be supplemented by further cover elements 31, 32 in the direction of the machine axis 27 that define a fibre-tight area. In this case, the auxiliary threads 14 are guided to the knitting systems 6 through this area by means of a respective tube 33, for example.

The drafting devices 8 and the spinning devices 21 preferably have an associated central suction arrangement 34 with coaxially arranged tubes 34*a*, 34*b*, which is connected to a suction device schematically provided with the reference pu and connects to the area between the cover elements 31, 32.

Suction channels 34*c* lead from the tube 34*a* to the rollers of the drafting devices 8 to be subjected to suction. The extracted fibres are fed to the process again as circulating material, for example, by a card.

The tube 34*b* of the central suction arrangement with channels 34*d* also picks up all waste that discharges between the spinning tubes of a spinning device 21 at the transition points of one spinning system to a following spinning system. This waste consists of shell parts and non-spinnable short fibres. These are not recycled.

The channels 34*a*, 34*b* of the central suction arrangement 34 are arranged concentrically, as a result of which all associated radially extending suction channels 34*c*, 34*d* have the same vacuum conditions within their category.

The drafting devices 8 guiding the fibres are fastened to the underside of the partition wall 26. As shown schematically in FIG. 3, in contrast to FIGS. 1 and 2, these can have horizontally arranged drafting rollers 35 and/or vertically arranged drafting rollers 36. The horizontal drafting rollers 35 of a pre-drafting field are preferably rotatably disposed in one or more, preferably pull-out drafting device housings 37, which are preferably connected to the partition wall 26 by means of screws, bayonet closures or the like to be easily detachable. In contrast, the vertical drafting rollers 36 of a main drafting field are provided, for example, with shafts or shaft ends 39, which project perpendicularly through the partition wall 26 and are rotatably disposed in bearings located above the partition wall 26 and fastened to this. Alternatively, the shafts 39 can be connected to associated drive elements of the drive units 28 by means of coupling elements 40 projecting through the partition wall 26, as is schematically indicated in FIG. 3 and explained in more detail below.

Figure 4:
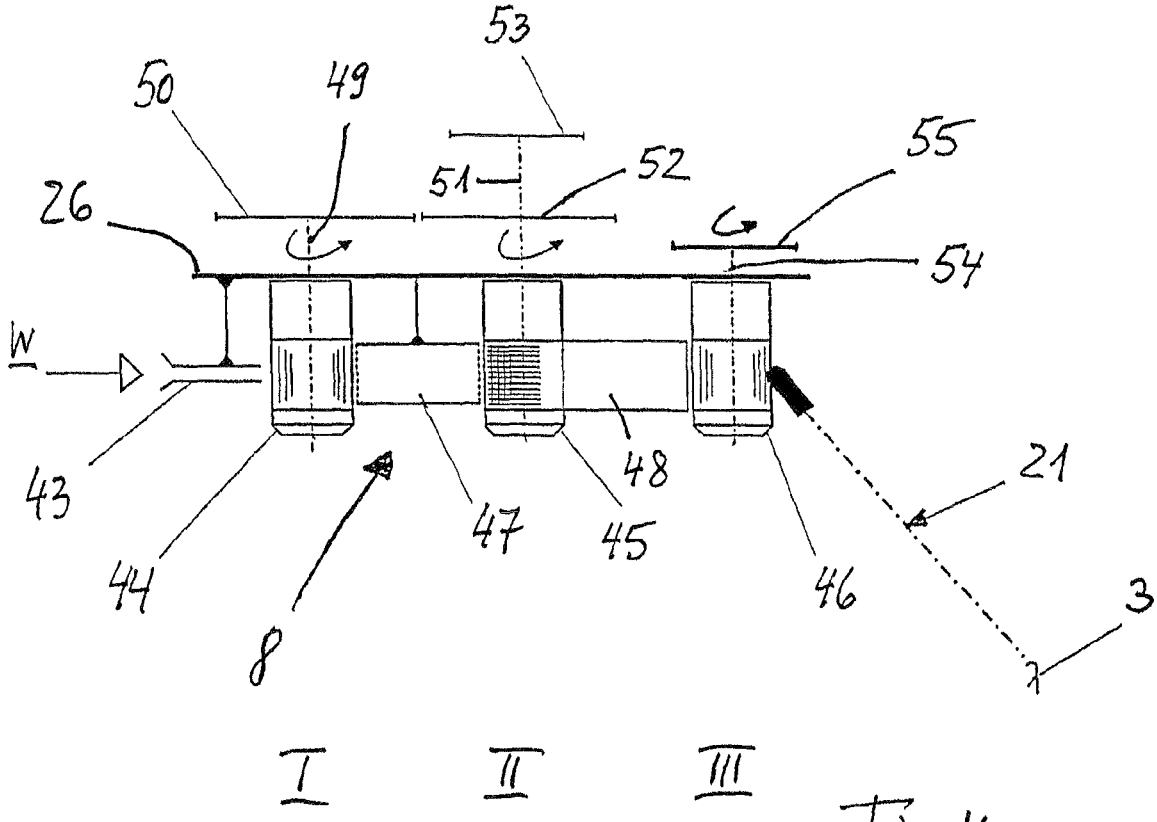
Figure 5:
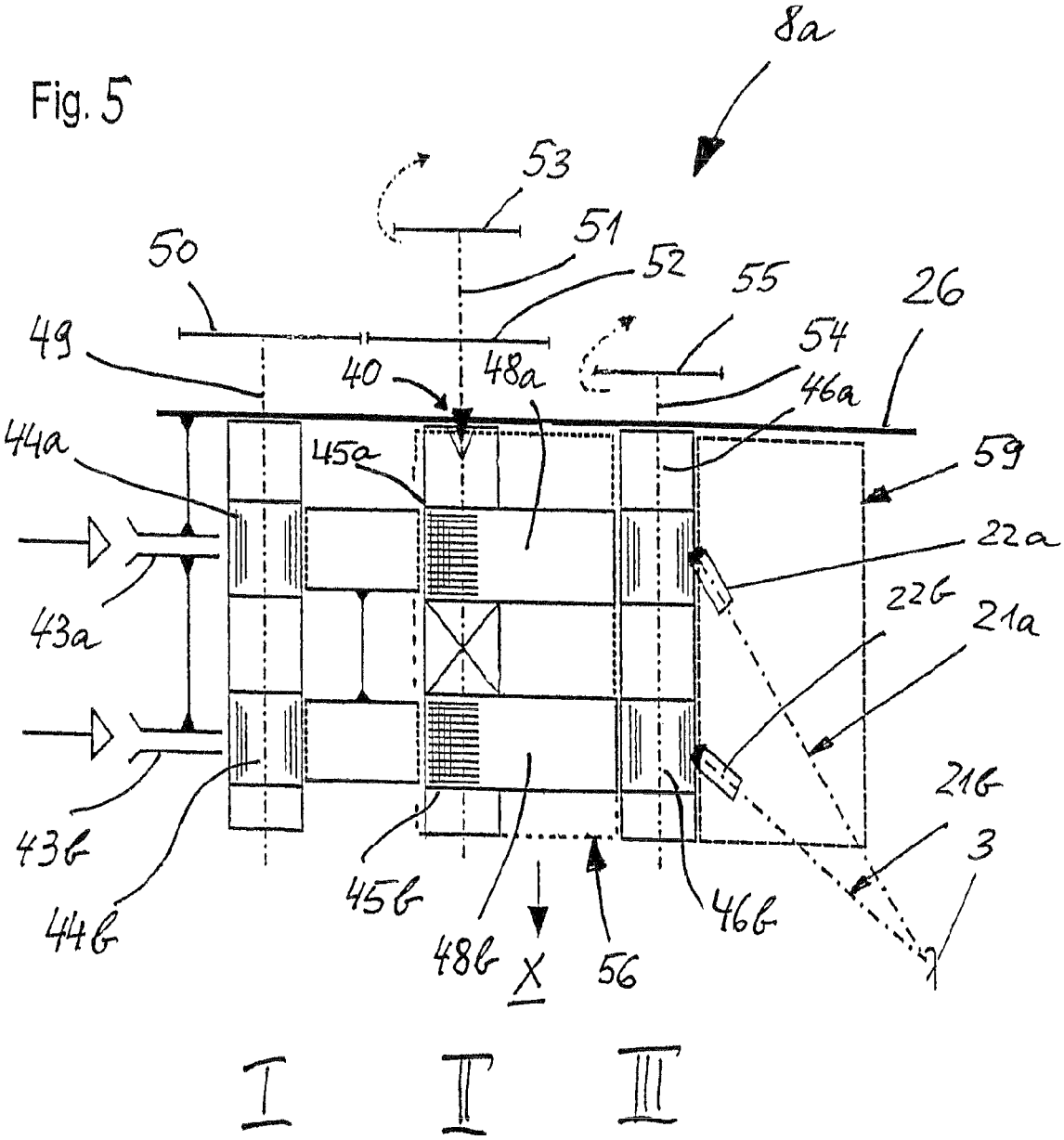

FIGS. 4 to 6 show different types of drafting devices that can be selectively connected to the partition wall 26 by way of example. However, it is understood that other types of drafting devices can also be provided as an alternative.

FIG. 4 shows a simple 3-roller drafting device such as is used in the processing of flyer frame sliver, for example, which is fed to the drafting device in the direction of an arrow w by means of a feeder 43 fastened to the partition wall 26. The pairs I, II and III of drafting rollers guiding the fibre material, of which only one respective roller 44, 45 and 46 is visible in FIG. 4, are cantilevered to the partition wall 26, i.e. the drafting rollers 44, 45 and 46 project freely downwards from their bearing points not shown in FIG. 4. A fibre guide channel formed by intermediate pieces 47 can be located between the pairs I and II to facilitate threading of the fibre material, whereas a fibre guide means using standard aprons 48, which form an apron assembly with the centre rollers 45, can be provided between pairs II and III. The reversing rails or deflection elements associated with the aprons 48 are not shown separately.

The drive units necessary to drive the drafting rollers 44 to 46 are fastened to the partition wall 26 above it and are operatively connected to associated drafting rollers 44, 45 and 46 through the partition wall 26. In particular a drive shaft 49 passing through the partition wall 26 is rotatably disposed thereon, said drive shaft being provided with a spur gear 50 above the partition wall 26 and coupled to a driving (bottom) roller of the feed roller pair I above or below the partition wall 26. On a further drive shaft 51, preferably also projecting through the partition wall 26, for the drafting roller 45, which forms the bottom roller of the central roller pair II, a spur gear 52 is fastened and a pulley 53 is fastened in a plane located above this. Finally, a pulley 55 is fastened on a further drive shaft 54 for the drafting roller 46 projecting through the partition wall 26, for example, this drafting roller being the bottom roller of the withdrawal roller pair III. Pulley 53 is driven, for example, by means of a first drive belt (not shown) and pulley 55 is driven by a second drive belt (likewise not shown), as is explained in more detail further below. Because of the meshing of the spur gears 50, 52 into a transmission gear (not shown), the first drive belt simultaneously drives the feed roller 44, wherein a preselected pre-draft can be created between the roller pairs I and II by selecting the tooth numbers of the spur gears 50, 52. Alternatively, the two spur gears 50, 52 can also be coupled by a continuous toothed belt to drive them in the same direction of rotation. The top rollers of roller pairs I, II and III not visible in FIG. 4 are disposed in usual press arms, for example, (e.g. 19 in FIG. 2) and are biased by spring force or the like against the bottom rollers 44, 45 and 46, so that they are set in rotation by these by means of friction.

FIG. 5 shows details of a double 3-roller drafting device 8*a* configured in the same way as in FIGS. 1 and 2. This differs from that according to FIG. 4 mainly in that the three drafting roller pairs I, II and III form two paths for each fibre material strand, which run below the partition wall 26 in two superposed planes. For this purpose, two feeders 43*a*, 43*b* located one above the other are fastened on the partition wall 26, whereas the drive shafts 49, 51 and 54 themselves standing vertically and perpendicularly to the partition wall 26 are respectively coupled to two drafting rollers 44*a*, 44*b*, 45*a*, 45*b* and 46*a*, 46*b* arranged coaxially one above the other. Moreover, aprons 48*a*, 48*b* can be provided, which each form an apron assembly together with the centre rollers 45*a*, 45*b*. As a result, the fibre materials discharging from the drafting device are fed, for example, between adjacent knitting systems of the circular knitting machine by means of two spinning devices 21*a* and 21*b*.

As indicated by broken lines, the apron assemblies are arranged in a common insertion part 56, which is normally fastened to the partition wall 26 during operation of the circular knitting machine, but after detachment of the preferably easily released fastening elements, can be pulled downwards out of the knitting device 8*a* in the direction of an arrow x. As a schematically shown coupling 40 additionally indicates, the shaft, on which the driven apron assemblies sit, can be decoupled when the insertion part 56 is pulled out of the coaxially arranged drive shaft 51 located above it and provided with the pulley 53. The periodically necessary changing of the aprons is facilitated by this arrangement.

Adjoining the withdrawal rollers 46*a*, 46*b* is preferably a nozzle assembly 59 essentially consisting of a closed housing, in which air nozzles intended for blowing on the withdrawal rollers 45*a*, 46*b* and described below, and additionally extraction channels for loose fibres and air supplies for pneumatic twist elements 22*a*, 22*b* of spinning devices 21*a*, 21*b* (cf. FIG. 2) are housed as further function parts. The nozzle assembly 59 can also be configured as a downwardly removable insertion part, which is connected to the partition wall 26 to be easily detachable.

The withdrawal rollers 46*a*, 46*b* could also be arranged in a corresponding manner in an insertion part, which is connected to or decoupled from the drive shaft 54 with a further coupling. In contrast, because they are at a larger radial distance from the machine axis 27 (FIG. 3) of the circular knitting machine 1, analogously to FIG. 2, the driven rollers of pair I are preferably disposed on a common press arm (not shown) that can be pivoted to the side, and that could also be replaced by two individual press arms.

Figure 6A:
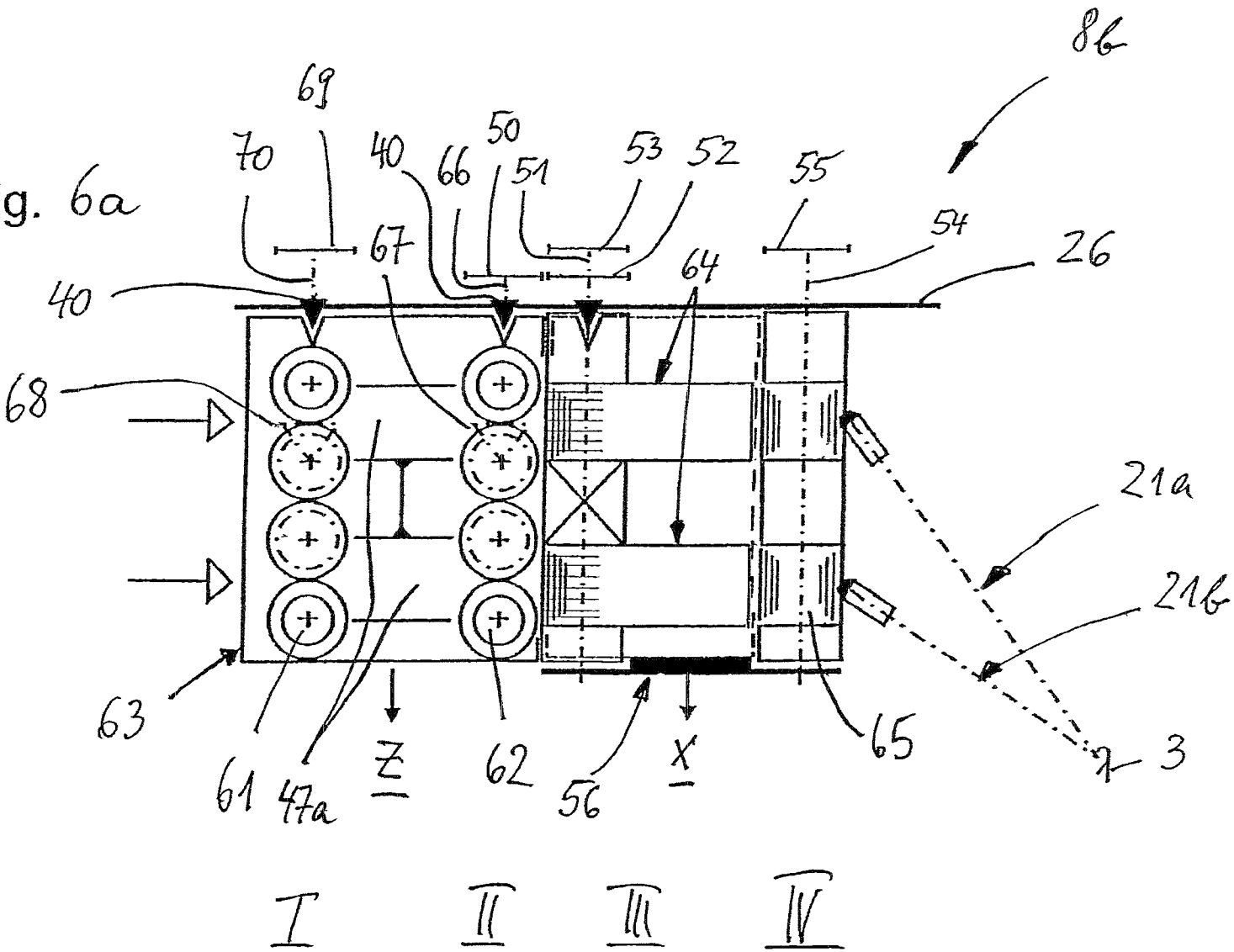

The exemplary embodiment of a drafting device 8*b* according to FIG. 6*a*, which substantially corresponds to that according to FIG. 3, differs from that according to FIG. 5 in that it is configured as a 4-roller folding drafting device, which is preferably used to process drafter sliver. For this purpose, drafting rollers 61 of a feed pair I, which are horizontal during operation, and drafting rollers 62 of a second pair II, which form a pre-drafting zone with these and are likewise horizontal during operation, are arranged in the side walls of an insertion part 63. Like insertion part 56 according to FIG. 5, insertion part 63 is fastened to the partition wall 26 to be easily detachable and can pulled downwards in the direction of an arrow z out of the drafting device 8*b* or from the partition wall 26. In this way, it is possible to completely free the area in front of following apron assemblies 64 of a pair III of drafting device elements, to which a withdrawal pair IV of drafting rollers 65 connects in the transport direction of the fibre material. Pairs III and IV of the drafting rollers are configured and arranged in a similar manner to FIG. 5, for example, and constitute the main drafting zone. Pairs II and III constitute a folding zone, wherein the distance between the drafting rollers 62 of pair II and those of pair III is selected so that the fibre flow exiting from the second pair II is folded by pair III in a characteristic manner, as is proposed in a further older application of the same applicant (PCT WO 2007/093164).

The driving (bottom) rollers of pairs III and IV are arranged vertically during operation and are therefore preferably driven in a similar manner to FIG. 5. Since the axes of the drafting rollers 61, 62 of the two first pairs I and II are arranged horizontally, they cannot be driven directly by drive shafts corresponding to the vertical drive shafts 49 (FIG. 5). Therefore, a bevel gear 67 and a coupling 40 respectively indicated by a black triangle as in FIGS. 3 and 6, for example, are arranged between a drive shaft 66 provided here with the spur gear 50 and the shaft of the second pair II supporting the bottom rollers 62. Therefore, when pulling out or inserting the insertion part 63, the drafting rollers 62 are coupled for drive operation to the drive shaft 51 and the pulley 52 via the bevel gear 67, the coupling 40 and the spur gears 50 and 52. In a corresponding manner, the shafts of the bottom rollers 61 are coupled to a vertically arranged drive shaft 70 provided with a pulley 69 via a bevel gear 68 and a coupling 40. As a result, it is possible to arrange all the drive shafts 51, 54, 66 and 70 provided above the partition wall 26 vertically.

Otherwise, the drafting device 8*b* according to FIG. 6 is configured as a tandem drafting device like the drafting device according to FIG. 5, which in superposed planes respectively has two identical pairs of drafting rollers and thus two paths for drafting two fibre material strands. Moreover, fibre guide channels, which are formed by intermediate pieces corresponding to the intermediate pieces 47 according to FIGS. 4 and 5, are indicated by the reference numeral 47*a*.

Figure 6B:
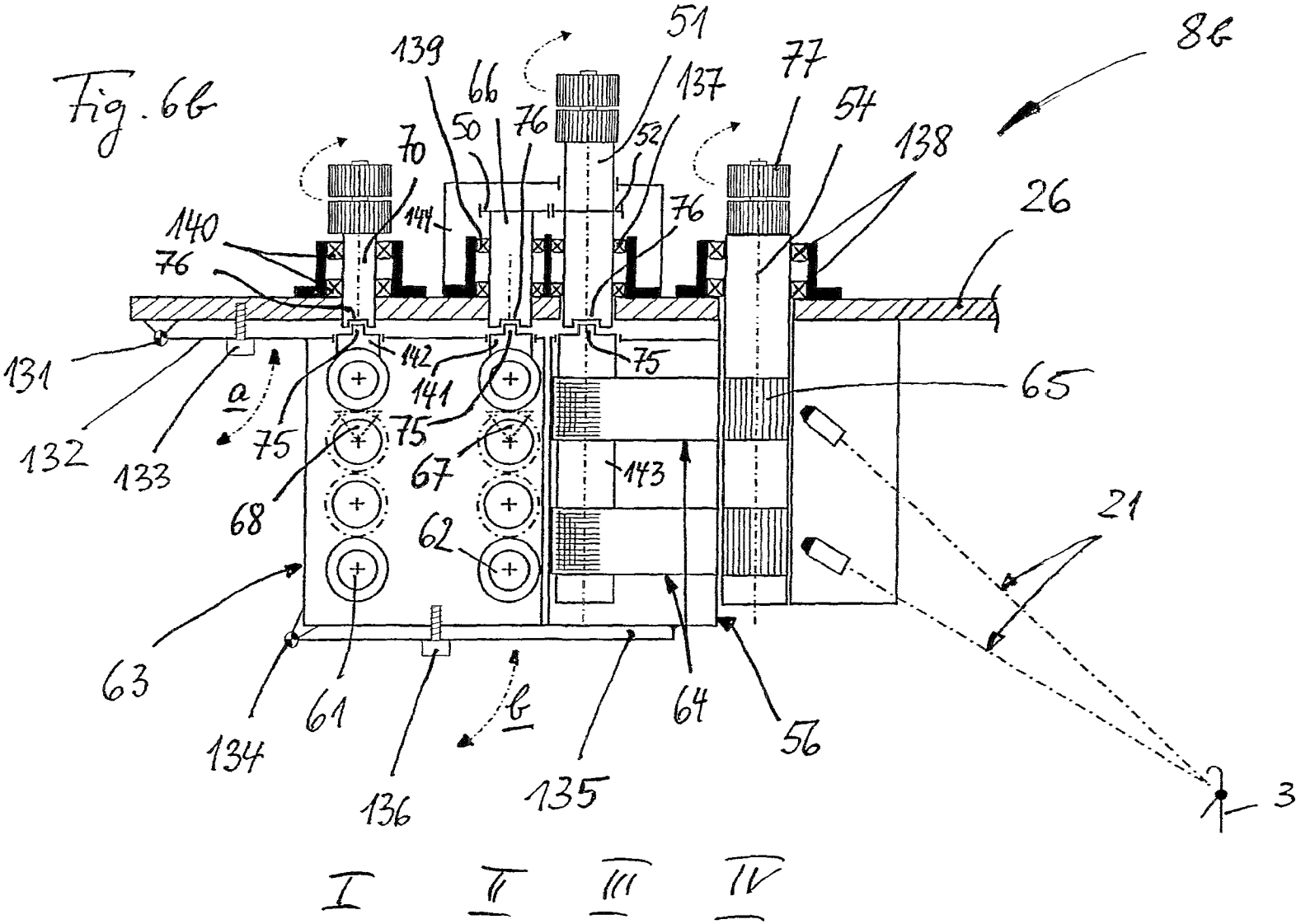

The exemplary embodiment according to FIG. 6*b* differs from that according to FIG. 6*a* in that the insertion parts 56 and 63 are fastened to be able to pivot instead of being displaceable on the partition wall 26. For this, a pivot point 134, by means of which a support arm 132 is disposed to pivot (arrow a) on the partition wall 26 and which is detachably fastened to this by means of a screw 133 or the like, is provided on the underside of the partition wall 26. Moreover, a pivot point 134, by means of which a support arm 135 is disposed to pivot (arrow b) on the insertion part 63 and which is detachably connected to this by means of a screw 136 or the like, is provided on the underside of the insertion part 63. The insertion part 56 is fastened to a part of the support arm 135 projecting beyond the insertion part 63 in the direction of transport of the fibre. The arrangement is selected overall in such a manner that by releasing the screw 133 both insertion parts 63 and 56 can be pivoted jointly in the direction of arrow a by means of the support arm 132. The apron assemblies 64 are additionally accessible by releasing the screw 136. In addition, both insertion parts 56 and 63 can be opened relative to one another.

Apart from this, FIG. 6*b* also more clearly shows an exemplary rotatable mounting of the drive shafts 51, 54, 66 and 70 by means of bearings 137 to 140 fastened to the partition wall 26 as well as a possible configuration of the couplings 40 (FIGS. 5 and 6*a*). In the exemplary embodiment, these contain coupling pins 75 on one side that sit on front ends of intermediate shafts 141, 142 running to the bevel gears 67, 68. Coupling pins for the drafting rollers 143 are also provided. On the other side, the couplings 40 contain coupling bushes 76 adapted to the coupling pins 75 configured at front ends of the associated drive shafts 51, 66 and 70. The arrangement is additionally selected such that a pivoting or displacement movement of the insertion parts 56, 63 in the direction of the arrows a, b or arrows x, z automatically leads to a separation or engagement of the respectively associated coupling parts 75, 76.

The drive shafts 51 and 66 and the spur gears 50, 52 of the spur gear stage are preferably arranged in a fibre-tight manner in a housing fastened to the partition wall 26.

It is understood that the drafting devices 8, 8*a* and 8*b* explained on the basis of FIGS. 3 to 6*b* only represent preferred exemplary embodiments. Alternatively, other drafting devices can also be provided, in particular 5-roller drafting devices, wherein it is possible by means of couplings 40 (FIG. 5) and gears 67, 68 (FIG. 6) or similar structural parts to arrange all drive shafts vertically and substantially above the partition wall 26 regardless of whether the associated drafting rollers are arranged vertically or horizontally.

The drive shaft 54 is short in configuration compared to the drive shafts 51 and 66. Since the drive shaft 53 rotates at high speed in relation to drive shaft 51, the kinetic energy involved in the movement is reduced. This facilitates braking during operational disturbance.

With the tandem design according to the invention at least two drafting devices are located one above the other and have common drive elements, which lie above the partition surface 26.

FIG. 7*a* shows an insertion part 56, which is preferably used for a 3-roller drafting device according to FIG. 5. The insertion part 56 includes an H-shaped housing 71 in front view, which is provided on the outer sides with long legs 71*a* with screw holes, threaded holes 72 or the like. Drafting rollers 45*a*, 45*b* bottom rollers) are rotatably disposed in a crossbar 71*b* of the H-shaped housing 71. These have resiliently associated drafting rollers 73*a*, 73*b* (=top rollers) also disposed in the crossbar 71*b* at the top and bottom. Moreover, deflection elements 74 (reversing rails) for the upper and lower drafting device are adjustably fastened to the crossbar 71*b* to guide the aprons 48*a*, 48*b* in a known manner.

FIG. 7*a* additionally shows that the drafting roller 45*a* or its shaft, for example, is configured to be axially longer than the adjacent drafting roller 73*a* or its shaft and, for example, projects above the upper side of the legs 71*a* with a square or hexagonal coupling pin 75, for example, in accordance with FIG. 6*b*. In accordance with FIG. 6*b*, this coupling pin 75 positively cooperates with the coupling bush 76 open towards it, which is fastened to the lower end of the drive shaft 51 associated with this apron assembly, is also square or hexagonal, for example, and is intended to receive the coupling pin 75 in a rotationally fixed manner. Thus, if the insertion part 56 configured in accordance with FIG. 7*a*, for example, is pivoted or pulled downwards from the partition wall 26, the parts 75 and 76, which represent the couplings 40 indicated schematically in FIGS. 5 and 6*a*, are automatically separated from one another. On the other hand, the arrangement is such that when the insertion part 56 is moved towards the partition wall 26 the coupling pin 75 automatically enters the coupling bush 76 and thus connects the apron assembly to the associated drive shaft 51. After the insertion part 56 is laid against the partition wall 26, it is fastened, e.g. with fastening screws 133, 136 (FIG. 6*b*), by means of cooperating resilient catch elements or similar.

By pulling the insertion part out in direction X, the aprons 48*a*, 48*b* can be easily replaced and the reversing rails 74 adjusted.

The types of drafting devices shown in FIGS. 6*a* and 6*b* are folding drafting devices, the insertion parts 56, 63 of which are configured to either be pulled or pivoted from a partition wall 26.

Two designs are possible: single tandem design and double tandem design.

In the case of the single tandem design, two drafting devices located one above the other have common drive elements, which lie above and below the partition surface 26 (FIGS. 6*a*, 6*b* and FIG. 7*a*).

In the case of the double tandem design, two drafting devices located one above the other are provided with two drafting devices located one above the other in parallel and are combined into a drafting device assembly, which has common drive elements that lie above and below the partition wall 26 (FIGS. 6*a*, 6*b* and FIG. 7*b* as well as FIG. 12).

In the case of the single tandem design according to FIGS. 6*a* and 6*b*, a construction such as that shown in FIG. 7*a* can be applied as insertion part 56.

In the case of the double tandem design, for example, a configuration according to FIG. 7*b* can be used as insertion part 56. It has a cross-shaped housing 71 and is provided for use according to FIG. 6*b*. The housing 71 is connected to a support arm 135 on the insertion part 63—see FIG. 6*b*—by means of a screw 136. After release of the screw 136, the insertion part 56 can be pivoted. The shaded area of the housing 71 abuts against the partition wall 26 in the operating state.

A respective drafting device is located in the four quadrants of the housing 71. The drafting roller 143 is present in duplicate and is respectively provided with the corresponding allocation of aprons 48*a*, 48*b*, reversing rails 74 etc.

The drafting rollers 143 have couplings 40, by means of which the torque is introduced by the drive elements above the partition wall 26.

FIG. 7*c* shows a plan view of FIG. 7*b*. The dotted circles symbolise the drive shafts 54—main withdrawal drafting field—including resiliently abutting associated top rollers. These structural parts are connected to the partition wall 26 by means of bearings 138. The housing 71 contains the drafting rollers 143 as in FIG. 6*b*, which are connected to the drive by means of positive couplings 40.

Aprons 48*b* are shown that are tensioned with clamping elements 48*c* (FIG. 7*c*). Adjustable reversing rails 74 are additionally provided. The support arm 135 is indicated.

The drafting rollers 143 at the entry of the main drafting field are coupled to one another by means of the two spur gears 50 and 52. These spur gears 50 and 52 are arranged above the partition wall 26—see also FIG. 12*a*.

The insertion part 56 can be pivoted from the partition wall. The aprons 48*a* as well as the reversing rails 74 are freely accessible as a result of this. Changing of the aprons 48*a*, 48*b* and also adjusting of the reversing rails 74 is facilitated or made possible.

The described drafting devices can be driven in a manner usual for drafting devices. For example, it would be possible to provide each drafting device 8, 8*a* and 8*b* according to FIGS. 3 to 6*b* with a separate drive motor for the different bottom rollers. In FIGS. 3, 6*a* and 6*b* this would respectively require three drive motors and in FIGS. 4 and 5 respectively two drive motors per drafting device, which would be comparatively expensive in the case of a multisystem circular knitting machine. A substantial saving could be achieved by driving pulleys of all drafting devices of a circular knitting machine that belong together by means of a respective tangential belt drive, which has a drive motor and a drive belt tangentially surrounding all associated pulleys (e.g. PCT WO 2007/0931-66, FIG. 11). As a result of this, however, there would be the disadvantage that with the presence of a great many drafting devices, the associated pulleys 50, 53, 55 and 69 would respectively only be wrapped by tangential belts abutting against them at a comparatively small angle of wrap.

Moreover, the tangential belts could only abut against some of the pulleys if they were deflected multiple times and thus subjected to alternating bending movements. However, that is undesirable when using usual drive belts, e.g. those configured as toothed belts, in particular if high circumferential speeds are necessary and high torques must be transferred, since the toothed belts would wear quickly as a result. According to a particularly preferred, and currently considered the best, exemplary embodiment of the invention, therefore, drive units evident from FIGS. 8 to 12 are provided.

FIG. 8 shows a multiplicity of pulleys 77 arranged on a circle, wherein this can concern the pulleys 53, 55 or 69 of all drafting devices 8 (FIGS. 4 to 6*a*), for example, that are distributed around the machine axis 27. Since their drive shafts 49, 51 and 54 are arranged vertically, they or the pulleys 77 shown in FIG. 8 can all be arranged in one and the same plane. If a drive belt 78 is now applied tangentially to these pulleys 77 and a drive pulley 79, which sits on the output shaft of a drive motor 80, then it follows from FIG. 8 that some of the pulleys that are provided with the reference 81 in FIG. 8 cannot be contacted by the drive belt 78 unless this is deflected multiple times. To avoid this disadvantage, at least the pulleys 77 corresponding to FIG. 9 are configured as double pulleys, which have two sections 77*a* and 77*b* located axially one above the other for abutment of the drive belt 78 shown in FIG. 8 by a solid line and a second drive belt 83 shown in FIGS. 7 and 8 by a dot-dash line. Therefore the first drive belt 78 according to FIGS. 8 and 9, for example, is laid tangentially against the sections 77*a* of the pulleys 77 and the drive pulley 79, whereas the second drive belt 83 is laid tangentially against the sections 77*b* of the pulleys 77, moreover against the pulleys 81 laid in the same plane as the sections 77*b* and also against a tension roller 84. As a result the pulleys 81 can also be driven tangentially without alternating bending of the drive belts 78 and/or 83. Alternatively, the pulleys 81 can naturally also be configured like pulleys 77, in which case one of the two sections 77*a*, 77*b* would remain free. Moreover, the two sections 77*a*, 77*b* can be formed by two separate pulleys sitting on the same shaft.

As a result of the described arrangement of FIGS. 8 and 9, it is possible, even if circular knitting machines are provided with needle cylinders with diameters of 30" and more and with a large number of knitting systems, to lay the first drive belt 78 around the drive pulley 79 with a sufficiently large angle of wrap of 90°, for example, which is sufficient for transmission of the necessary torques. In contrast, the pulleys 77 and 81 are only wrapped with comparatively small angles of 10°, for example. This is sufficient at least for those pulleys that must overcome the existing bearing friction, which applies, for example, to the pulleys 55 and 69 in FIGS. 4 to 6. This also applies in particular because in the case of a multi-system circular knitting machine the second drive belt abuts tangentially against a large number of pulleys 77, whereas the number of pulleys 81 to be driven by it is comparatively small.

With respect to the pulleys 53, for example, which must not only drive directly associated drafting rollers (e.g. 45), but must also drive adjacent drafting rollers (e.g. 44) and/or apron assemblies (e.g. 64 in FIG. 6) by means of the gears 50, 52 (FIGS. 4 to 6) or are active by means of bevel gears 66, 68, such high braking moments can result that the drive belts 78, 83 preferably used tend to rise, as it were. In such a case, relative movements occur between the teeth of the drive belts 78, 83 and the teeth of the respective pulleys, which can lead to jerking movements or even to outage of a drive unit. In a preferred variant of the drive unit evident from FIG. 8, it is therefore provided that the respective pulleys each have an associated auxiliary or contact roller 85, which is laid against the toothed belts 78 and 83 from the outside and presses these against the pulleys 77 and 81 respectively. If necessary, the auxiliary rollers 85, like pulleys 77, can be configured as double rollers in the sense of FIG. 9. Moreover, the auxiliary rollers 85 preferably lie either on the respective drive belt (e.g. 78) at the precise point where this abuts against the respective pulley 77 (FIG. 9*a*) or at a location (FIG. 9*b*) lying a short distance (e.g. by two teeth at most) in front of this in order to prevent the said damaging alternating bending movement. Since the auxiliary rollers 85 should only ensure that the teeth of the pulleys and the drive belt remain in engagement, it is generally sufficient to place the auxiliary rollers 85 opposite the pulleys 77, 81 at a short radial distance, i.e. without any direct contact.

Figure 10B:
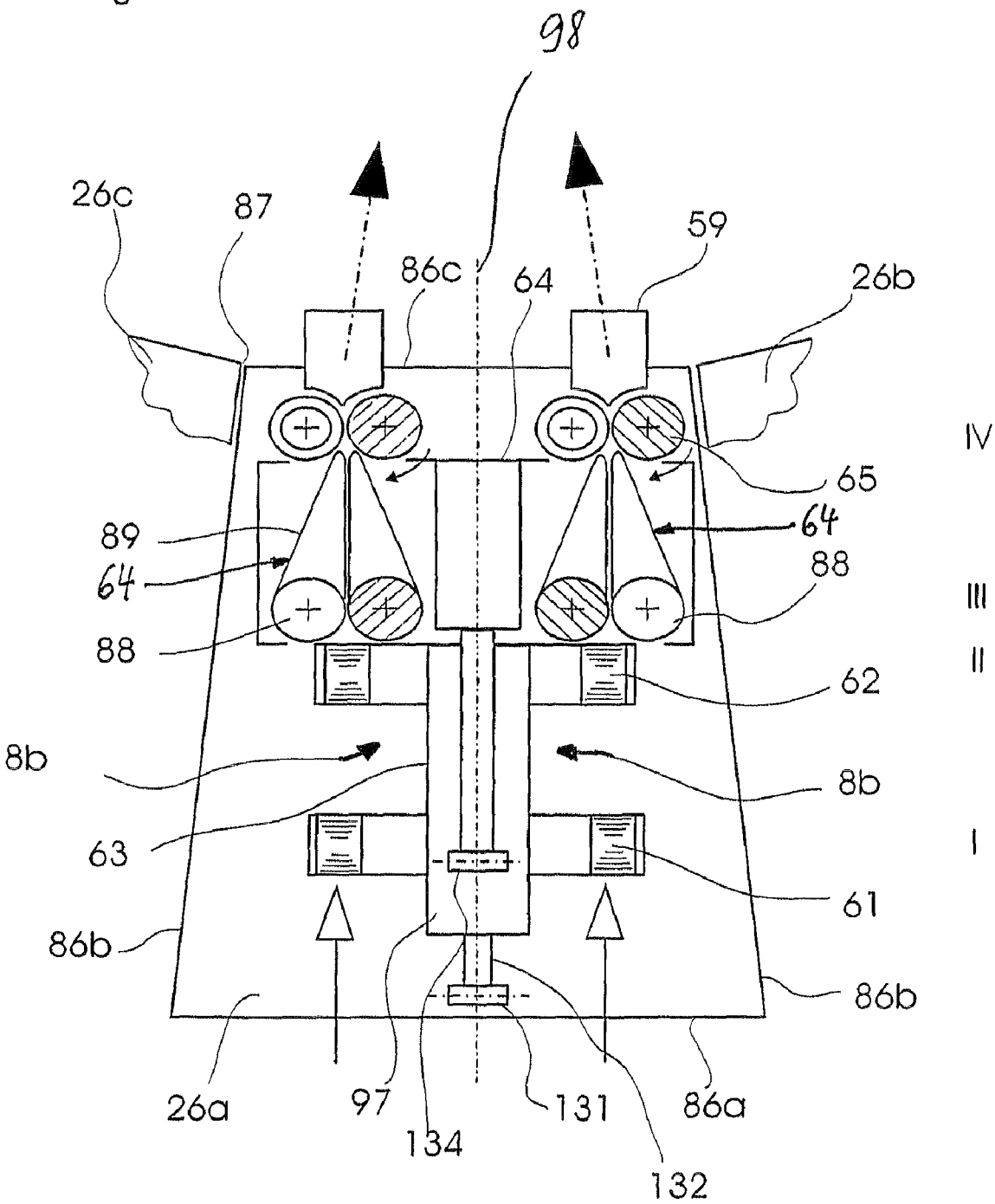

FIGS. 10*a* to 12*a* and FIGS. 10*b* to 12*b* show a trapezoid partition wall segment 26*a* as well as two variants of a drafting device arrangement mounted on this segment 26*a* including the associated drive unit. The drive unit according to FIGS. 10*a* to 12*a* differs from the drive unit according to FIGS. 10*b* to 12*b* in the transfer of the drive torques to the drafting device elements. The function of the fibre-guiding parts of the drafting device elements is the same for both variants. The segment 26*a* has equally long side edges 86*a* and 86*b*, a short inner edge 86*c*, which comes to lie radially on the inside, and a long outer edge 86*d* located opposite this. These edges 86*a* to 86*d* are dimensioned in such a way that a multiplicity of such segments 26*a* can be laid next to one another in the manner of the slices of a cake and, placed around the machine axis 27 (FIG. 3), can be connected to one another to form a substantially closed ring in the peripheral direction. This is indicated in FIGS. 10*a* and 10*b* by two adjacent only partially shown segments 26*b* and 26*c*. Between the individual segments 26*a* to 26*c* there preferably remain small fibre-tight gaps 87, if necessary, so that the segments can be placed together to form a fibre-tight partition wall, which completely covers the area between the drafting devices and the drive units.

As the bottom view of FIGS. 10*a*, 10*b* shows in association with FIGS. 12*a*, 12*b*, each segment 26*a* is provided with a drafting device arrangement, which consists of two drafting devices 8*b* configured in accordance with FIGS. 6*a*, 6*b*, of which only the two lower roller pairs are visible in the bottom view according to FIGS. 10*a*, 10*b*. Each drafting device 8*b* therefore includes two pairs I of feed rollers 61, which with the rollers 62 of two further drafting roller pairs II form a respective pre-drafting zone (6- to 10-fold draft). There then follows a respective apron assembly 64, which together with the drafting devices 62 of pairs II each form a folding zone (10% draft) and of which only drafting rollers 88 are shown in FIGS. 12*a*, 12*b*, but without associated aprons 89 (FIGS. 10*a*, 10*b*), to simplify the drawing. The withdrawal rollers 65 form the end, these each forming a main drafting field (e.g. 20- to 30-fold draft) with the apron assemblies 64 and with a respective nozzle assembly 59 possibly following (cf. FIG. 6 in each case). As FIGS. 12*a* and 12*b* show in particular, for each segment 26*a* two such drafting devices 8*b* are connected next to each other to form a drafting device arrangement, which delivers the fibre materials required for four knitting systems, and are connected to one another by common drive elements. The bottom rollers or driving rollers are respectively shown shaded in FIGS. 10*a*, 10*b* and 11*a*, 11*b*. In accordance with the above description this also concerns so-called folding drafting devices, in which the rollers of pairs I and II are arranged perpendicularly to those of pairs III and IV, so that the fibre materials are folded between the drafting rollers of pairs II and III in a characteristic manner.

Such drafting devices 8*b* are suitable in particular for processing drafter sliver.

The representation according to FIGS. 10*a* and 10*b* relates to four folding drafting devices that form an assembly—see also FIGS. 6*a* and 6*b*. Two folding drafting devices are respectively arranged one above the other on either side of a plane of symmetry 98.

The drafting in the folding zone (pairs II/III) is slight. It is determined by transmission. The drafting actions of the pre-draft zone and the main draft zone are freely selectable. Thus, three synchronous motors are necessary to drive all the drafting devices.

FIGS. 10*a* and 10*b* additionally show a gearbox 97, which sits directly on the partition wall segment 26*a* by means of the support arm 132 (FIG. 6*b*) with the pivot point 131. The rollers 61 and 62 of pairs I/II project from the gearbox 97 on both sides. The surrounding structural parts according to FIG. 6*a* such as e.g. the fibre guide channels 47*a* etc. are not shown.

Located at the bottom on the gearbox 97 is the pivot point 134, to which the support arm is articulated, which supports the insertion part 56 that includes the apron assembly (pair III) (cf. FIG. 6*b*).

The drafting rollers 65 or their shafts project through the partition wall 26*a* (cf. FIG. 6*b*) and following them is a respective nozzle assembly 59 containing the spinning and auxiliary elements.

The driven rollers are shown shaded in FIGS. 10*a* and 10*b*. The difference in configurations according to FIGS. 10*a* and 10*b* lies in the position of the driven rollers of pairs III in relation to the plane of symmetry 98. This is associated with the different arrangement of the drive elements of pairs II/III that are located above the partition wall segments 26*a*. The different arrangement of the drive elements is shown in FIGS. 11*a*, 11*b* and 12*a*, 12*b*. The reason for this lies in the magnitude of the driving torques, which occur with different numbers of knitting systems.

The necessary driving torques for the pairs I and IV are low. Only the bearing friction must essentially be overcome. The fibre material to be drafted only takes a negligible power. The necessary driving torque for pairs is substantially higher, since the aprons generate a braking moment.

FIGS. 11*a* and 11*b* each show a plan view onto a partition wall segment 26*a*. The torque for pairs I is transferred by means of a tangential belt 92 and a belt wheel ZR1, which corresponds to the pulley 69 in FIG. 6*a*.

In the variant according to FIGS. 11*a* and 12*a*, the torque for pairs II/III is transferred by means of a tangential belt 95 to belt wheels ZR II/III 1 and ZR II/III 2, which correspond to the pulleys 53 in FIG. 6*a*. The belt wheel ZR II/III 1 feeds pairs III (left) directly and pairs II via an intermediate gear with the spur gears 50 and 52 according to FIG. 6*a*. The torque flow is indicated by a double arrow M1 in FIG. 11*a*. Pairs III (right) are fed directly by belt wheel ZR II/III 2.

Pairs IV respectively receive the torque via a tangential belt 96, against which belt wheels ZR IV 1 and ZR IV 2 abut, which respectively feed the associated pairs IV and correspond to the pulleys 55 in FIG. 6*a*.

The angles of wrap W (FIG. 11*a*) are particularly critical for the drive of pairs II/III. For the first variant according to FIGS. 10*a*/11*a*/12*a*, the following angles of wrap W result, depending on the number of knitting systems:

| | Number of knitting systems | | |
|---|---|---|---|
| Pairs | 48 | 72 | 96 |
| I | 30° | 20° | 15° |
| II/III | 15° | 10° | 7.5° |
| IV | 15° | 10° | 7.5° |

The angle of wrap W is too small for pairs II/III with a higher number of systems to transfer the high power necessary, and therefore the second variant according to FIGS. 10*b*, 11*b*, 12*b* is suggested for this purpose.

A preferred embodiment is proposed in FIGS. 10*b*, 11*b*, 12*b* that results in a larger angle of wrap W on pairs II/III. In contrast to the first variant (FIGS. 10*a*, 11*a*, 12*a*) only one belt wheel ZR II/III 1 is present. Thus, the following angles of wrap W result, depending on the number of knitting systems:

| | Number of knitting systems | | |
|---|---|---|---|
| Pairs | 48 | 72 | 96 |
| I | 30° | 20° | 15° |
| II/III | 30° | 20° | 15° |
| IV | 15° | 10° | 7.5° |

Moreover, as FIG. 12*b* shows, a spur gear 90*a* is fastened to the drive shaft 51 here, which meshes with a spur gear 90*b* that sits on the drive shaft 66 (FIG. 6*a*). While pairs II and III are only driven by means of a single belt wheel ZR II/III 1 as a result of this, this variant allows an angle of wrap W that is double in size.

Taking into consideration a sufficiently large angle of wrap W for pairs II/III, only a low number of knitting systems (e.g. 48 systems) is preferably conceivable for the first drive variant. The second variant is preferred in the case of a larger number of knitting systems (e.g. 72 or 96 systems).

The structure of a drafting device group with gears according to FIGS. 12*a* and 12*b* together with the interaction thereof with partition wall segments 26*a* will now be explained in more detail in FIGS. 12*c* to 12*g*. FIG. 12*c* shows the drive of pairs I. The toothed belt 92 drives the belt wheel ZR1, which sits on the drive shaft 70. The coupling 40 transfers the torque to an intermediate shaft 142 (cf. also FIG. 6*b*), which transfers the torque via the bevel gear stage 68 and a spur gear stage 91*a*, 91*b* to pairs I (four). The partition wall 26*a* lies between these and separates the drive from the fibre-guiding parts. The gearbox 97 is detachably associated with the partition wall 26*a* (can be pulled out or pivoted). This arrangement is the same for both variants.

FIGS. 12*d* and 12*e* show the drive of pairs II/III according to the first variant (FIG. 12*a*). The toothed belt 95 drives a belt wheel ZR II/III, which sits on the drive shaft 51. The coupling 40 transfers the torque to an intermediate shaft 143, which is part of pair III. The intermediate shaft 143 is disposed in the insertion part 56.

The spur gear 50, which meshes with the spur gear 52 on the drive shaft 51, sits on the drive shaft 66. The torque M1 is branched here—see also FIG. 11*a*. The spur gears 50 and 52 have defined the folding drafting operation. The torque of gear 52 is transferred by means of the drive shaft 66 and a further coupling 40 to the intermediate shaft 141, which transfers the torque to the pairs II (four) by means of a bevel gear stage 67 and a spur gear stage 93*a*, 93*b*. The partition wall 26*a* separates the drive from fibre-guiding parts. The insertion part 56 and the gearbox 97 (also indicated as insertion part 63 in FIG. 6*b*) are detachably associated with the partition wall 26*a*. Four pairs II and two pairs III are covered with this arrangement. The missing two pairs III have a separate drive with respect to the tangential belt 95—see FIGS. 11*a* and 12*a*. The structure of this drive is shown in FIG. 12*e*. According to FIG. 12*e* the drive is performed by a tangential belt 95, which drives the belt wheel ZR II/III. The torque is directed by means of the drive shaft 51 and by means of the coupling 40 to drafting roller 143 (FIG. 6*b*) or drafting roller 88 (FIG. 10*a*). This is disposed in the insertion part 56.

FIG. 12*f* shows the drive and the mounting of pairs IV. This is the same for both variants (FIGS. 12*a* and 12*b*). The two pairs IV 1 and IV 2 are mounted and driven separately, but are otherwise identical in design. The tangential belt 96 drives a belt wheel ZR IV/1, which sits on the drive shaft 54 and represents the bottom feed rollers 165 or pair IV. The drive shaft 54 is disposed in the bearing 138, which is fixedly connected to the partition wall 26/26*a* (FIG. 6*b*).

FIG. 12*g* shows the structure of the drive group II/III for the second variant according to FIGS. 10*b*/11*b*/12*b*. This corresponds to the gear shown in FIG. 12*d*. In addition, the spur gear stage 90*a*, 90*b* (cf. FIG. 12*b*) is present, which divides the torque—M2 in FIG. 11*b*. The left spur gear 90*b* of stage 90*a*, 90*b* is shown rotated 90° out of the plane of the drawing for reasons of clarity, since it would otherwise not be visible in the side view according to arrow v (FIG. 12*b*). FIG. 12*b* shows the entire arrangement in an angled view. Thus all pairs (four) are driven by a single belt wheel ZR II/III, which results in a sufficiently large angle of wrap.

The described exemplary embodiments show that according to the invention the drive units are arranged above the partition wall 26 and the fibre-guiding drafting rollers below the partition wall or below the respective partition wall segments 26*a*. The driven units include in particular pulleys and toothed belt wheels, the drive (toothed) belts abutting against them and the drive motors provided for them or the like according to FIGS. 8 and 9. In contrast, necessary gear parts such as e.g. the different spur gear stages 90, 91 and 93 as well as the bevel gears (e.g. 67, 68) are arranged above or below the partition wall, as expedient, and in a separate gearbox (e.g. 97) if necessary. Moreover, it is understood that the drive shafts (e.g. 54 in FIG. 6*b*) can project through the partition wall 26 or partition wall segments 26*a*, and then in a section located above the partition wall 26, 26*a*, can have the function of a drive shaft, but the function of a drafting roller in a section located below the partition wall 26, 26*a*, or can be provided with regions that form the drafting rollers (cf. e.g. FIG. 12*f*).

Otherwise it is clear that in accordance with the above description it is always only the so-called bottom rollers that are driven by the different drafting roller pairs I to IV, whereas the so-called top rollers are applied against these by means of press arms or the like and are therefore entrained by the bottom rollers by friction. However, since the so-called bottom rollers do not lie at the bottom and the so-called top rollers do not lie at the top in the exemplary embodiments, the bottom rollers are preferably referred to as the driving drafting rollers and the top rollers as the driven drafting rollers.

To drive the drive belts 92, 95 and 96 three drive motors 80 according to FIG. 8 are used, their output speeds being selected such that a desired draft is adjusted between the roller pairs I, II or II, III or III, IV. As a result, an extremely economical drive unit is created in association with the total of ten gear or bevel gear wheels per drafting device arrangement (FIGS. 10*a* to 12*a*) or twelve gear or bevel wheels (FIGS. 10*b* to 12*b*) and because of the circumstance that these are only needed to drive comparatively slow-running drafting rollers, which enables the use of inexpensive gear or bevel gear wheels. 24 such drive units are required for a circular knitting machine with 96 knitting systems. Moreover, the advantage results that with practically identical structural elements knitting machines with e.g. 72 or 48 knitting systems can also be operated by providing the segments 26*a* with a correspondingly lower number of drafting rollers.

FIG. 13 shows a schematic plan view onto the partition wall 26, which is made up completely of segments 26*a* or is also configured in one piece, here in a circular ring shape, with a plurality of pulleys 77, two tension rollers 84, drive motors housed in a housing 99, which drive the drive belts 92 and 95, and the concealed drafting devices 8*b*. Moreover, FIG. 13 shows a variant in that the drive belt 96 for the feed rollers 65 lies directly against a pulley 100 located opposite it, which in turn according to FIG. 8 sets the other pulleys of the feed rollers in rotation via a second drive belt. Since this relates to very rapidly rotating drafting rollers, which are driven, for example, at speeds of 2000 rpm to 4000 rpm, the pulley 100 is preferably provided with three sections arranged coaxially one above the other, one of which guides the drive belt 96. Abutting against the other two sections are two further drive belts 101 and 102, which each run over a tension roller 103 or 104 and thus do not abut against some of the pulleys in the region thereof, as is shown in FIG. 8 for the tension roller 84.

FIG. 14 shows the exemplary embodiment according to FIG. 13, but after the covering 30 is mounted in a fibre-tight manner (FIG. 3), as a result of which the drive units are arranged in a closed area located above the partition wall 26. Moreover, because the gear parts arranged between the drive units and the drafting rollers are respectively arranged in a gearbox 97, the operation of the driven units and the gear parts is substantially maintenance-free.

FIGS. 15 to 21 show an exemplary embodiment, which differs from the exemplary embodiment according to FIGS. 10 and 11 by differently formed partition wall segments 26*b* and furthermore differs from all the exemplary embodiments described hitherto in that it has a 5-roller drafting device 8*c* with two superposed paths for the fibre material.

The partition wall segment 26*b* according to FIGS. 15 and 16 is likewise substantially trapezoid in configuration and in the region of the feeder 43*a*, 43*b* is provided with a long outer edge 105*a* that lies opposite a shorter inner edge 105*b*. A first side edge 105*c* is provided with a concave recess 106, whereas a second side edge 105*d* has a convex attachment 107. This is shaped such that it fits exactly into the recess 106. Therefore if two or more segments 26*b* according to FIG. 17 are arranged next to one another with their side edges, then the attachment 107 of any one segment 26*b* respectively positions itself in the recess 106 of an adjacent segment 26*b*, so that the segments 26*b* can be laid next to one another in a fibre-tight arrangement in the manner of the slices of a cake in a similar manner to FIGS. 10 and 11 in order to form, for example, a partition wall that is circular ring-shaped overall. The purpose of the attachment 107 is, for example, to arranged a pulley 77 there (cf. e.g. FIG. 16).

As FIG. 15 further shows, adjoining the feeders 43*a*, 43*b* the drafting device 8*c* has two respective pairs I and II of drafting rollers 108 and 109 located one above the other, which correspond to the drafting rollers 61 and 62 according to FIG. 6, but are arranged vertically instead of horizontally. Moreover, two respective pairs III and IV of drafting device elements are present that, like in FIG. 6, form two apron assemblies 64 located one on top of the other with drafting rollers 110 and two feed rollers 65 located one on top of the other. While the rollers 108*a*, 109*a*, 65*a* and the apron assemblies 64*a* are forcibly driven, their associated drafting rollers 108*b*, 109*b*, 65*b* and apron assemblies 64*b* are the respective driven drafting device elements.

An additional pair V of drafting device elements consisting of horizontally arranged drafting rollers 111 is respectively provided between the drafting device pairs II and III. In this case, the ratios are selected such that the rollers 109 and 111 form a folding zone in the sense of the folding zone between the drafting rollers 62 and apron assemblies 64 according to FIG. 6, in that e.g. the feed width of the sliver in the nip line of the rollers 109*a*, 109*b* is set to 16 mm and the spacing of the nip lines between the rollers 109*a*, 109*b* and 111 is set to about 30 mm, so that a W-shaped fold results and the sliver leaving the rollers 111 only has a width of approximately 4 mm. On the other hand, the spacing between the nip lines of rollers 111 and rollers 110*a*, 110*b* of the apron assemblies 64*a*, 64*b* at e.g. about 30 mm compared to the sliver that is still only approximately 4 mm is adjusted to be so large that no new fold occurs here.

The exemplary embodiment according to FIGS. 15 to 21 has the advantage above all that only a drive bevel gear is required to drive the drafting rollers 111, since the axes of all the other drafting rollers are arranged vertically during operation and are connected, for example, via the couplings 75, 76 (FIG. 5).

Otherwise the exemplary embodiment according to FIGS. 15 to 21 corresponds substantially to the exemplary embodiments according to FIGS. 1 to 14, and therefore the same reference numerals are used for the same parts. This applies above all to the drive units with the pulleys 77 also present in FIGS. 15 to 21.

It is also evident from FIG. 15 in particular that the driven drafting rollers 108*b* and 109*b* can be mounted on usual press arms 19 (cf. also FIG. 2) and can be pivoted away to the side together with these where necessary.

Finally, FIGS. 18 to 21 shows that in keeping with the above description at least the drafting rollers of pairs III, IV and V are preferably mounted in pull-out insertion parts 112 and 113 detachably fastened to the segment 26*b*. All the insertion parts 112, 113 are in inserted operating state in FIG. 18. FIG. 19 schematically shows insertion part 112 pulled downwards, and FIG. 20 shows insertion part 113 pulled downwards. Alternatively, instead of in the insertion part 112 the feed rollers 65*a*, 65*b* can also be fixedly fastened to the partition wall segment 26*b*, as indicated by broken lines in FIG. 19.

As was explained in detail in association with FIG. 5, a respective nozzle assembly 59, also indicated in FIGS. 10 and 11 and in FIGS. 18 to 21, is preferably arranged behind each pair of feed rollers in the transport direction of the fibres. This nozzle assembly 59 can also be configured as an insertion part that can be pulled out downwards, which is shown in pulled out state in FIG. 21.

In the case of disturbances such as lapping etc., all fibre-guiding function elements can be cleaned by pulling the respective holder or by pivoting the respective top rollers (e.g. 108*b*). The insertion part 112 configured as apron holder is configured to be adjustable in its fine geometry (forward hang, lag, position of the reversing rail for the aprons). The fine geometry changes or must be adapted if the material properties of the fibres to be processed make this necessary. According to the invention, the procedure for this is preferably as follows: the trial of a specific fine setting is conducted on an individual knitting system, which can be part of the so-called spinning knitting machine or is operated separately. If this is determined by trials, then the setting values are transmitted to a "gauge". All apron insertion parts 112 are then adjusted to the determined dimensions outside the circular knitting machine and are then inserted into this. This procedure allows a high resetting speed to be achieved while at the same time retaining a perfect uniformity and quality of the drafting process.

The nozzle assemblies 59 include in particular the compressed, blast and suction air conducting means necessary for spinning with the spinning devices 21 (FIG. 2). Details of the nozzle assembly 59 and a preferred air conducting means are indicated schematically in FIGS. 22 to 24.

FIGS. 22 to 23 show a nozzle assembly 59, which is attached to the partition wall 26, in side view. Two pairs of feed rollers 115 arranged one on top of the other are located below the partition wall 26. The nozzles or twist elements 22 (FIG. 2) of the subsequent spinning devices 21 project into the gusset of the feed roller pairs 115 and connect to a compressed air supply 116 (pü) active through the partition wall 26.

A blast air slot 117 (FIG. 23) connecting to a blast air source 119 (pb) via a blast air duct 118 projecting through the partition wall 26 is located at each work location. Air exits from the blast air slots 117 and swirls fibres and fibre particles on the surface of a roller pair 115, so that these can be removed in associated suction channels 120 and through extractor tubes 121 connected to a suction source (pu).

The blowing and suction systems are arranged at a short distance from the feed roller pairs 115. Ventilation openings 122 are provided if the blast air flow ejects a smaller quantity of air per unit time than can be discharged from the suction channels 120. The blast air channels and also associated blast air slots 117 and the compressed air supply 116 are parts of the nozzle assembly 59 or are connected to this. The nozzle assembly 59 is detachably connected to the partition surface 26, as shown in FIG. 21 in particular.

The arrangement of blast air slots 117, suction channels 120 and ventilation openings 122 allows an adequate fluff removal to be achieved with extremely low volumes of air per unit time for blast air and suction air. The production safety increases as a result of this. This applies both to arrangements with only one respective spinning device 21 (FIGS. 22, 23) and to those with a plurality of spinning devices 21 connected one behind the other (FIG. 24).

The invention is not restricted to the described exemplary embodiments that can be modified in a variety of ways. This applies in particular to the described press arms and insertion parts, which only represent examples that can be deviated from in a variety of ways. In particular, the insertion parts can be provided with elements that are not represented in more detail to press the driven rollers and aprons resiliently or pneumatically against the driving rollers and aprons during operation. Above all for function parts further away from the centre axis of the circular knitting machine, insertion parts that can be pulled out laterally could also be additional provided. In addition, it is clear that the function parts that must be maintained and possibly must be replaced on a frequent basis are preferably mounted on or in the pivoting press arms, insertion parts etc. in such a way that they can be easily replaced when these are in open position. For this, it is recommended to dispose the rollers and deflection elements (e.g. 74 in FIG. 7), where at all possible, at only one end (cantilevered) and to arrange their free ends at the bottom or to the side, so that at least the aprons can be removed after pivoting or pulling out the press arms, insertion parts etc. that can be configured as desired towards the free ends of the driving rollers. Moreover, the described drive and gear elements also only represent preferred examples. In particular, it is recommended to couple at least the very quick-running feed rollers (e.g. 65 in FIG. 6), drive shafts and pulleys (e.g. 54, 55 in FIG. 6), which are as short as possible in the axial direction and are also light, in order to keep the moving masses low and enable quick acceleration and above all braking processes. In place of toothed belts and toothed pulleys, for example, chain gears with drive chains and corresponding chain wheels and/or other elements can also be provided, and the spur gears 50, 52 etc. can be replaced by belt drives, for example. The described couplings can be configured in a different way than represented. For example, horizontally arranged drafting device elements can also be coupled to the drive units by means of helical gear stages. It is additionally clear that the drafting rollers are preferably provided with the usual coatings or are made from the usual material, wherein the top rollers in particular are expediently provided with flexible coatings. Moreover, quick-release closure elements, which allow the different structural parts to be released with simple manual actions, are preferably suitable for mounting the drafting device arrangements and/or the insertion parts on the underside of the partition wall. The shapes of the partition walls and partition wall segments can also be selected differently, depending on the individual case and the circular knitting machine used, in particular can be adapted to the design of the respective circular knitting machine. Finally, it is understood that the different features can also be applied in different combinations to those described and shown.

The invention claimed is:

1. Circular knitting machine for the production of knitted goods by at least partially using fibre materials (10, 11), including a machine axis (27), a multiplicity of knitting systems (6) distributed around the machine axis (27), drafting devices (8, 8*a*, 8*b*, 8*c*) having drafting rollers to feed the fibre materials (10, 11) at least to some of these knitting systems (6) and drive units (28) actively connected to associated drafting rollers to drive the drafting rollers, characterised in that a fibre-tight partition wall (26) is provided, which is arranged transversely to the machine axis (27), the drafting devices (8, 8*a*, 8*b*, 8*c*) being arranged below this partition wall (26) and the drive units (28) being arranged above it, and the drive units (28) being coupled to the associated drafting rollers through the partition wall (26).

2. Circular knitting machine according to claim 1, characterised in that it includes a base or cam plate (17) and the partition wall (26) is supported by a multiplicity of support columns (16), which are distributed around the machine axis (27) and are supported on the base or cam plate and/or on the ground.

3. Circular knitting machine according to claim 1, characterised in that the partition wall (26) surrounds the machine axis (27) in a ring shape or conically.

4. Circular knitting machine according to claim 1, characterised in that the partition wall (26) contains a multiplicity of segments (26*a*, 26*b*) lying against one another in a fibre-tight arrangement in the peripheral direction.

5. Circular knitting machine according to claim 1, characterised in that the partition wall (26) is provided on its upper side with a substantially closed covering (30) surrounding one of the drive units (28).

6. Circular knitting machine according to claim 5, characterised in that the covering (30) is supplemented by covering elements (31, 32) projecting in the direction of the machine axis (27).

7. Circular knitting machine according to claim 1, characterised in that the drafting devices (8, 8*a*, 8*b*, 8*c*) have shafts arranged parallel to the machine axis (27) for each pair of feed rollers (46, 65) in the installed state.

8. Circular knitting machine according to claim 1, characterised in that the drafting devices (8) have associated suction channels (34*c*) for fibre discharges and suction channels (34*d*) for dirt fragments, and the suction channels (34*c*, 34*d*) are connected to a central extractor (34).

9. Circular knitting machine according to claim 1, characterised in that the drafting devices (8*a*, 8*b*, 8*c*) are configured as double drafting devices intended for the parallel feed of at least two respective fibre materials (10, 11).

10. Circular knitting machine according to claim 1, characterised in that it contains at least one drafting device arrangement, which has two superposed drafting devices and two further drafting devices parallel thereto, which have common drive elements (ZRI, ZRII/III 1, ZRII/III 2, ZRIV 1, ZRIV 2), wherein a pre-drafting group (I, II) has horizontal shafts (67) and a main drafting group (III,IV) has (vertical) shafts (65) standing parallel to the machine axis (27).

11. Circular knitting machine according to claim 1, characterised in that the drafting rollers are arranged at least partially in insertion parts (56, 63, 112, 113), which are detachably connected to the partition wall (26) by means of couplings (40).

12. Circular knitting machine according to claim 11, characterised in that at least one insertion part (56) is configured in a cross shape, and with drafting devices located in four quadrants thereof, wherein the insertion part (56) is arranged to pivot on a further insertion part (63) by means of a support arm (135).

13. Circular knitting machine according to claim 12, characterised in that at least one drafting device (8*b*) has a first insertion part (63) disposed to pivot directly on the partition wall (26) by means of a support arm (132) and a first pivot point (131) and a second insertion part (56) connected to the first insertion part (63) to pivot by means of a support arm (132) and a second pivot pint (134), wherein the second pivot point (134) is arranged on a front lower corner of the first insertion part (63).

14. Circular knitting machine according to claim 1, characterised in that the drive units (28) are configured as tangential belt drives, and at least one drive unit for withdrawal rollers (46, 65) of the drafting devices (8) contains at least a first and a second drive belt (78, 83) and also a multiplicity of drive elements in the form of pulleys (77, 81), which are distributed around the machine axis (27) and which have at least partially superposed first and second sections (77*a*, 77*b*), wherein the first drive belt (78) tangentially surrounds the first sections (77*a*) of a first part of the pulleys (77) and the second drive belt (83) tangentially surrounds the second sections (77*b*) of a second part of the pulleys (77, 81).

15. Circular knitting machine according to claim 14, characterised in that the first drive belt (78) also surrounds a drive pulley (79) of a drive motor (80) and the second drive belt (83) also surrounds a tension roller (84) respectively tangentially and without alternating bending.

16. Circular knitting machine according to claim 14, characterised in that at least some of the pulleys (77, 81) have an associated auxiliary roller (85) for the first and/or second drive belts (78, 83), wherein the auxiliary roller (85) is arranged at the starting point of the respective drive belt (78, 83) or at a short distance in front of this.

17. Circular knitting machine according to claim 1, characterised in that in a transport direction of the fibre material behind the withdrawal rollers (115) of the drafting devices, a respective nozzle assembly (59) with a blower and suction system is fastened on the partition wall (26), which contains blower and suction openings (117, 122) associated with the withdrawal roller pairs (115).

* * * * *